US009250578B2

(12) United States Patent
Aoki

(10) Patent No.: US 9,250,578 B2
(45) Date of Patent: Feb. 2, 2016

(54) FIXING DEVICE AND IMAGE FORMING APPARATUS

(71) Applicant: CANON KABUSHIKI KAISHA, Tokyo (JP)

(72) Inventor: Kota Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/496,350

(22) Filed: Sep. 25, 2014

(65) Prior Publication Data

US 2015/0086234 A1 Mar. 26, 2015

(30) Foreign Application Priority Data

Sep. 26, 2013 (JP) ..... 2013-199238
Sep. 26, 2013 (JP) ..... 2013-199239

(51) Int. Cl.
*G03G 15/20* (2006.01)
*G03G 21/16* (2006.01)

(52) U.S. Cl.
CPC ..... *G03G 15/2017* (2013.01); *G03G 21/1619* (2013.01); *G03G 21/1685* (2013.01)

(58) Field of Classification Search
CPC ..... G03G 15/2017
See application file for complete search history.

(56) References Cited

U.S. PATENT DOCUMENTS

| | | | | |
|---|---|---|---|---|
| 5,525,775 | A | 6/1996 | Setoriyama et al. | |
| 2009/0290897 | A1* | 11/2009 | Doshoda et al. | 399/93 |
| 2011/0243598 | A1* | 10/2011 | Suzuki | 399/98 |
| 2011/0274458 | A1* | 11/2011 | Hijikata et al. | 399/98 |
| 2012/0141934 | A1* | 6/2012 | Morris et al. | 430/124.1 |

FOREIGN PATENT DOCUMENTS

| | | | |
|---|---|---|---|
| JP | 4-44075 | A | 2/1992 |
| JP | 2010-217580 | A | 9/2010 |
| JP | 2011-112708 | A | 6/2011 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes first and second rollers forming an image fixing nip, the second roller being disposed below the first roller; a casing accommodating the first and second rollers and having a sheet introduction opening and a sheet discharge opening; a suppression portion provided at a position, away by not less than 0.5 mm and not more than 3.5 mm, from a surface of the first roller in a space extending from the sheet introduction opening to the sheet discharge opening and configured to suppress scattering of particles of predetermined particle sizes resulting from the parting material adjacent the sheet introduction opening; and a substantially closed chamber provided above the casing and having an entrance for permitting entering of the particles guided to the outside of the casing by the suppression portion to stagnate the particles.

12 Claims, 18 Drawing Sheets

FIXING DEVICE AND IMAGE FORMING APPARATUS

FIELD OF THE INVENTION AND RELATED ART

The present invention relates to a fixing device for fixing a toner image to a sheet of a recording medium, and an image forming apparatus which employs a fixing device.

In the field of an electrophotographic image forming apparatus, it has been a common practice to form a toner image on a sheet of a recording medium (paper) with the use of toner which contains a parting agent (wax), and fixes the toner image to the sheet by applying heat and pressure to the sheet and the toner image thereon with the use of its fixing device (fixing apparatus).

It has been known that during the fixation of toner image to a sheet of a recording medium, the wax contained in toner vaporizes, and then, immediately condenses. It has been known by the inventors of the present invention that as the vaporized wax condenses, it turns into a large amount of microscopic particles (which are several nanometers to several hundred nanometers in size, and may be referred to as "dust", hereafter), and remain airborne in the adjacencies of the sheet entrance of the fixing device. Thus, unless some measures are taken to deal with the wax particles, which remain airborne in the adjacencies of the recording medium entrance of the fixing device right after their formation, it is possible that a substantial amount of the wax particles spread out of the fixing device, and have undesirable effects upon the image forming apparatus in terms of image quality. Thus, it is desired to turn the vaporized wax into wax particles which are large enough not to widely spread within the image forming apparatus.

In the case of the fixing device of the electromagnetic induction type disclosed in Japanese Laid-open Patent Application 2010-217580, a heat generating component is placed in the adjacencies of the coil holder to prevent wax particles from cumulatively adhering to the coil holder. More specifically, the wax particles having solidly adhered to the coil holder are heated by the heat generating component in order to make the wax particles liquefy and fall.

In the case of the fixing device disclosed in Japanese Laid-open Patent Application 2011-112708, its cleaning web for removing microscopic particles having adhered to the fixation roller is impregnated with particle capturing agents.

However, the fixing devices disclosed in Japanese Laid-open Patent Applications 2010-217580 and 2011-112708 cannot prevent the problem that the dust particles (microscopic wax particles), which are airborne in the adjacencies of the recording medium entrance of the fixing device, widely spread in the image forming apparatus. That is, the measures disclosed in these patent applications cannot be satisfactory solutions to this problem. In other words, there is a lot of room for improvement.

SUMMARY OF THE INVENTION

According to an aspect of the present invention, there is provided an image forming apparatus comprising an image forming station configured to form a toner image on a sheet with toner containing parting material; first and second rotatable members forming a nip therebetween configured to fix a toner image formed on the sheet by the image forming station, the second rotatable member being disposed below the first rotatable member; a casing accommodating the first rotatable member and the second rotatable member and having a sheet introduction opening and a sheet discharge opening; a suppression portion provided at a position, away by not less than 0.5 mm and not more than 3.5 mm from a surface of the first rotatable member in a space from the sheet introduction opening to the sheet discharge opening in the casing and configured to suppress scattering of particles of predetermined particle sizes resulting from parting material adjacent the sheet introduction opening; and a substantially closed chamber provided above the casing and having an entrance for permitting entering of the particles guided to a outside of the casing by the suppression portion to stagnate the particles.

Further features of the present invention will become apparent from the following description of exemplary embodiments (with reference to the attached drawings).

DESCRIPTION OF THE PREFERRED EMBODIMENTS

Hereinafter, embodiments of the present invention are described in detail. Unless specifically noted, the present invention is also applicable to various known devices (apparatuses) which are different in structure from those in the following embodiments of the present, within the scope of the present invention in spirit.

Embodiment 1

(1) Overall Structure Image Forming Apparatus

Figure 1:
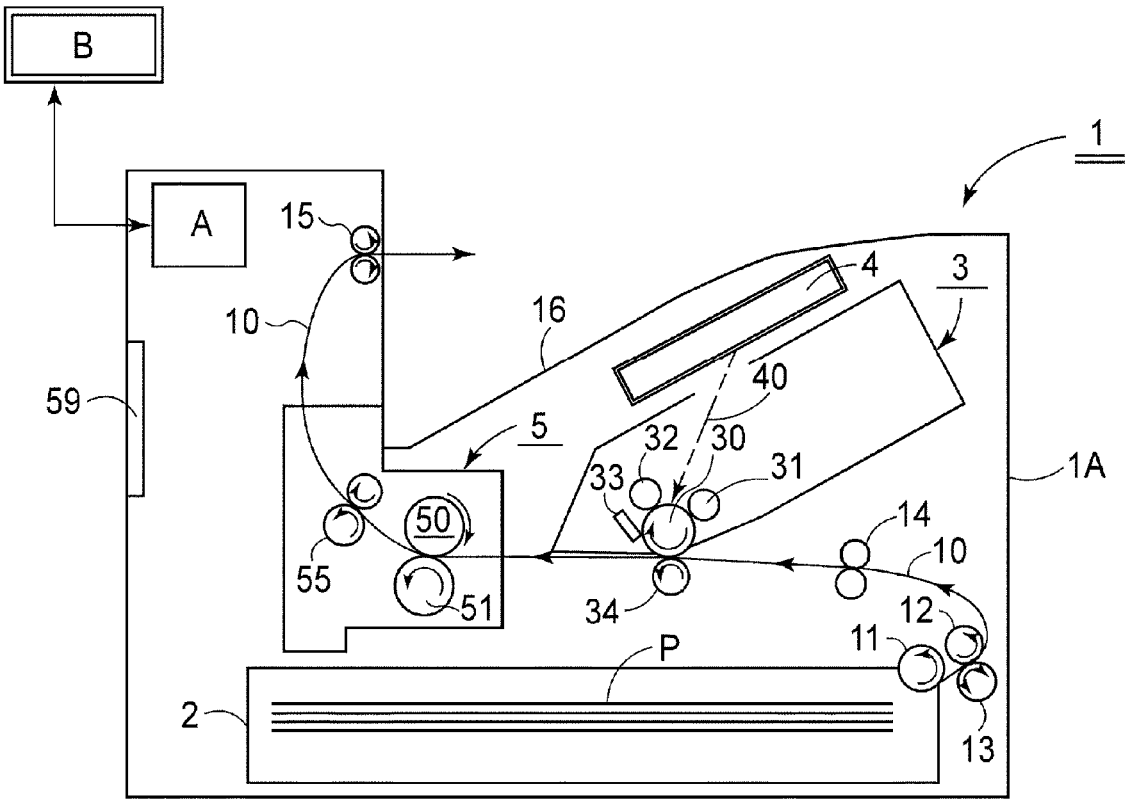
FIG. 1 is a schematic sectional view of the image forming apparatus in the first embodiment of the present invention.

Before beginning to describe the fixing device, an example of image forming apparatus equipped with a fixing device is described about its overall structure. FIG. 1 is a sectional view of the image forming apparatus 1 in this embodiment, which shows the overall structure of the apparatus. This image forming apparatus 1 is a laser beam printer which uses an electrophotographic image formation process. That is, it forms an image on a sheet of a recording medium, based on electrical image formation signals inputted into the control circuit (controlling means: CPU) of the apparatus from an external host apparatus B such as a personal computer, an image reader, and the like.

A sheet P of a recording medium is a medium on which a toner image is formed by an image forming apparatus. It includes a sheet of ordinary paper, cardstock, thin paper, an envelope, a postcard, a seal, resin, an OHT film, glossy paper, etc., which is specific or nonspecific in shape. In the following description of the embodiments, such terminologies as "sheet discharge, sheet conveyance, sheet feeding, sheet path portion, out-of-sheet-path portion", or the like are used for the sake of convenience. However, the application of the present invention is not limited to an image forming apparatus which is usable with only a sheet of paper.

The image forming apparatus 1 is equipped with an image formation engine (image forming section) which forms a toner image. The image formation engine is made up of a process cartridge 3 which is removably installable in the preset position in the main assembly 1A of the image forming apparatus 1, and an optical scanning device (laser scanner) 4.

The cartridge 3 is provided with a photosensitive component 30 which is rotationally driven, a charge roller 32, a development roller 31, and a cleaner 33, which are disposed in the casing (shell) of the cartridge 3. The cartridge 3 is structured so that it can form a toner image, which reflects the information of the image to be formed, on the peripheral surface of the photosensitive component 30. The charge roller 32 uniformly charges the photosensitive component 30 to a potential level which is equal to that of the background portions of an electrostatic latent image to be formed on the photosensitive component 30. The development roller 31 forms a toner image by developing an electrostatic latent image formed on the photosensitive component 30 by the exposure of the uniformly charged portion of the photosensitive component 30 to a beam 4 of light. The cleaner 33 cleans the photosensitive component 30.

The image forming apparatus 1 is provided with a transfer roller 34, which is positioned so that it opposes the photosensitive component 30 of the image formation engine. The optical scanning device 4 scans (exposes) the peripheral surface of the photosensitive component 30 with the beam 40 of light it emits while modulating the beam 40 according to the information of the image to be formed, in the direction parallel to the axial line of the photosensitive component 30.

Meanwhile, sheets of recording paper in a sheet feeder cassette 2, which is in the bottom portion of the apparatus main assembly 1A, are fed one by one into the apparatus main assembly 1A. There are positioned in parallel above the cassette 3, a pickup roller 11 and a sheet feeding-conveying roller 12, which are for pulling out the sheets P of recording paper in the cassette 2. Further, the apparatus main assembly 1A is provided with a retard roller 13, which is for preventing two or more sheets of recording paper from being conveyed together. The retard roller 13 is positioned in a manner to oppose the sheet feeding-conveying roller 12.

As a sheet P of recording paper is fed into the apparatus main assembly 1A, it enters a recording medium conveyance passage 10, through which it is sent to a pair of registration roller 14, which controls the timing with which the sheet P enters the transfer section, that is, the area of contact between the photosensitive component 30 and transfer roller 34. Thereafter, the sheet P is conveyed to the transfer section with a preset control timing, and is conveyed through the transfer section while remaining pinched by the photosensitive component 30 and transfer roller 34. While the sheet P is conveyed through the transfer section, it receives a toner image from the photosensitive component 30; a toner image is transferred onto the sheet P from the photosensitive component 30. After being conveyed through the transfer section, the sheet P is separated from the photosensitive component 30, and is sent to a fixing device 5, in which the toner image on the sheet P is thermally fixed to the sheet P. After being discharged from the fixing device 5, the sheet P is discharged, as a print, into a delivery tray 16, by way of a pair of discharge rollers 15. The delivery tray 16 is a part of the top wall of the apparatus main assembly 1A. Thereafter, the sheet P is conveyed to the transfer section with a preset control timing, and is conveyed through the transfer section while remaining pinched by the photosensitive component 30 and transfer roller 34. While the sheet P is conveyed through the transfer section, it receives a toner image from the photosensitive component 30; a toner image is transferred onto the sheet P from the photosensitive component 30. After being conveyed through the transfer section, the sheet P is separated from the photosensitive component 30, and is sent to a fixing device 30, in which the toner image on the sheet P is thermally fixed to the sheet P. After being discharged from the fixing device 5, the sheet P is discharged, as a print, into a delivery tray 16, by way of a pair of discharge rollers 15. The delivery tray 16 is a part of the top wall of the apparatus main assembly 1A.

(2) Structure of Fixing Device

Figure 2:
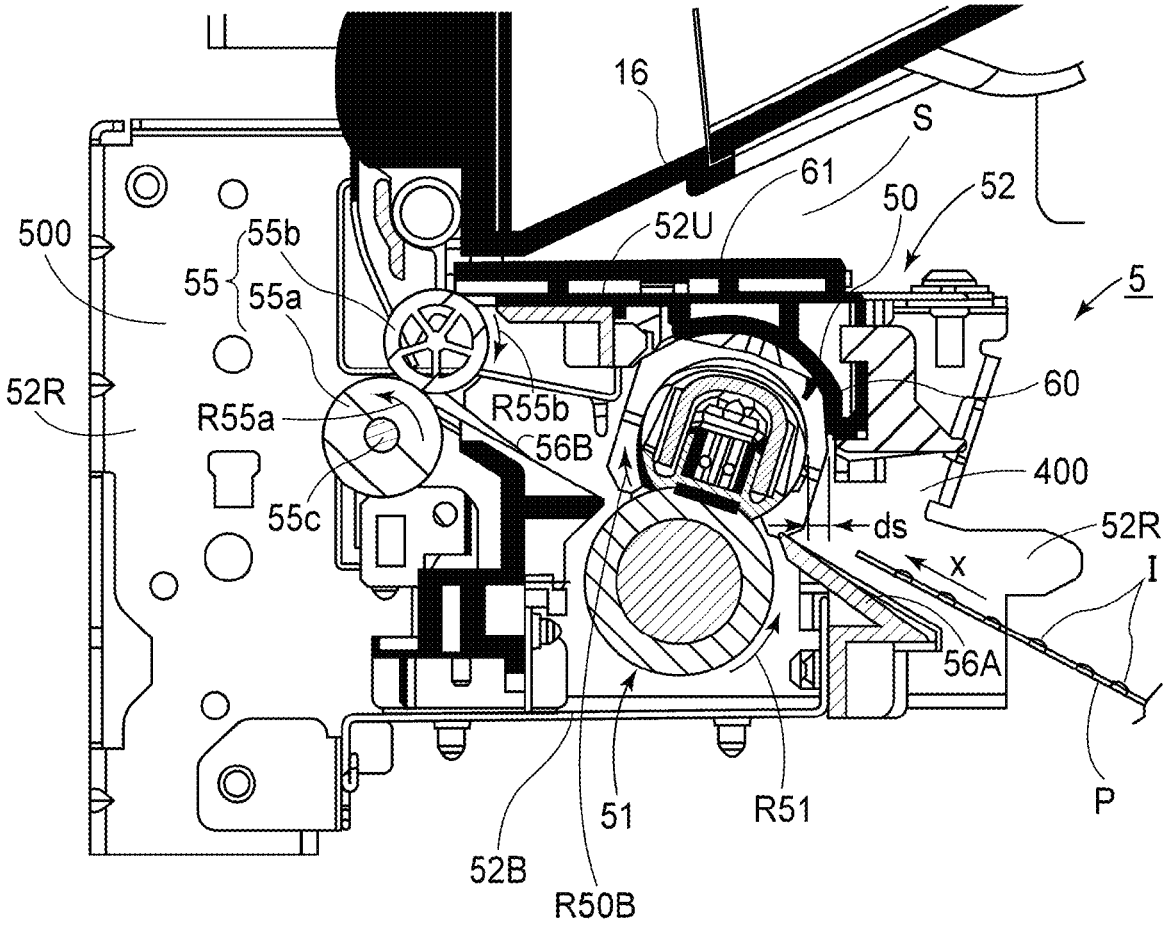
FIG. 2 is an enlarged schematic cross-sectional view of the fixing device, and its adjacencies, of the image forming apparatus shown in FIG. 1.
Figure 3A:
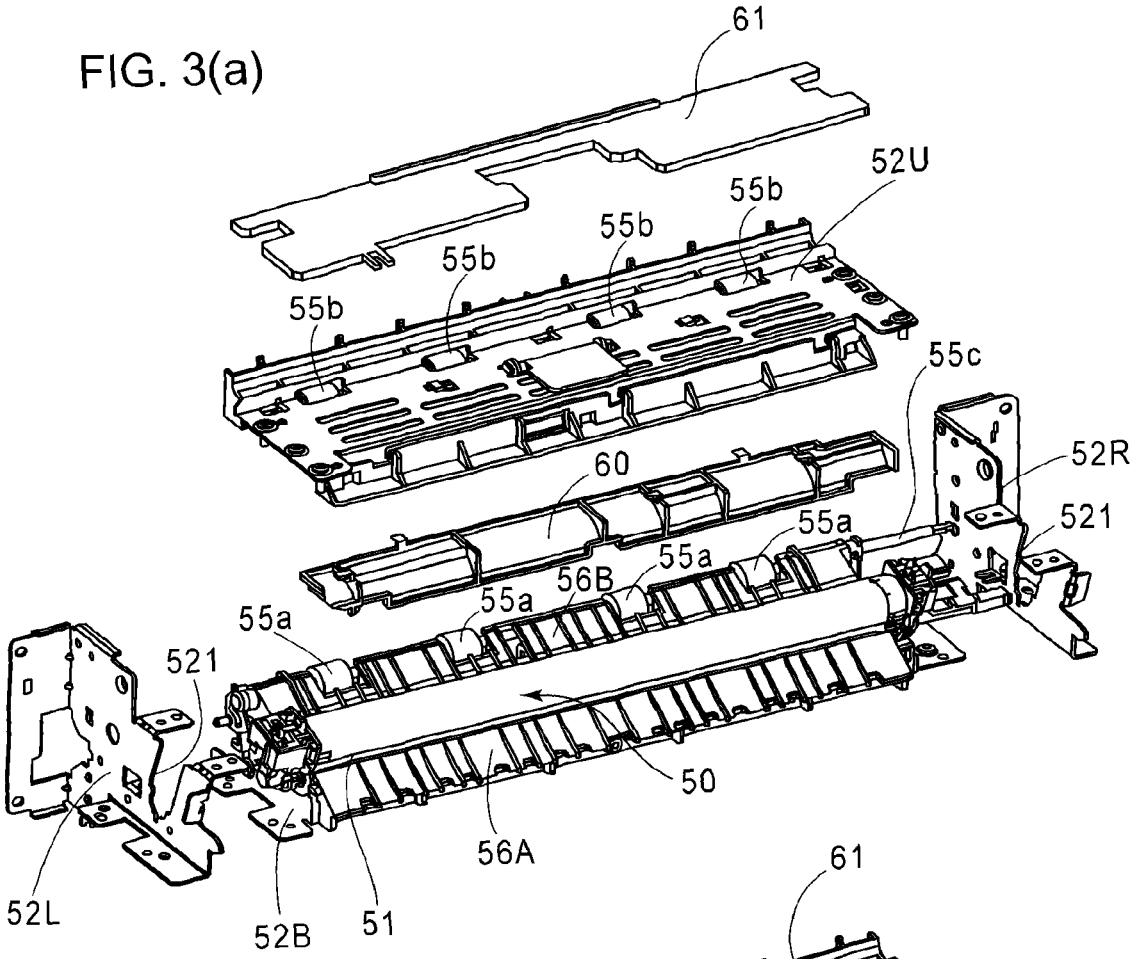
FIG. 3(*a*) is an exploded perspective view of the fixing device, and FIG. 3(*b*) is a perspective view of the second air current blocking component, which is in the state in which it is above the top cover of the casing of the fixing device.
Figure 3B:
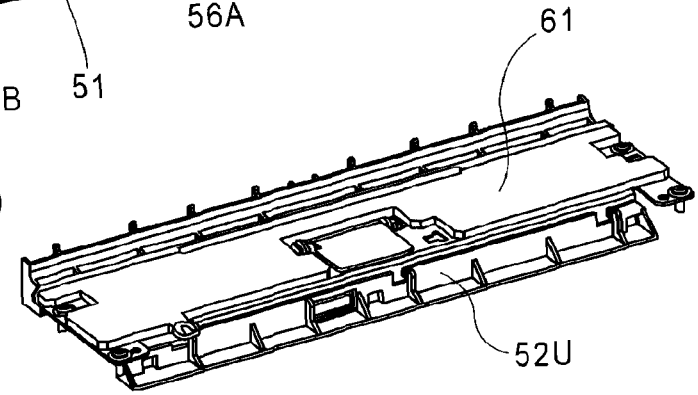
Figure 4:
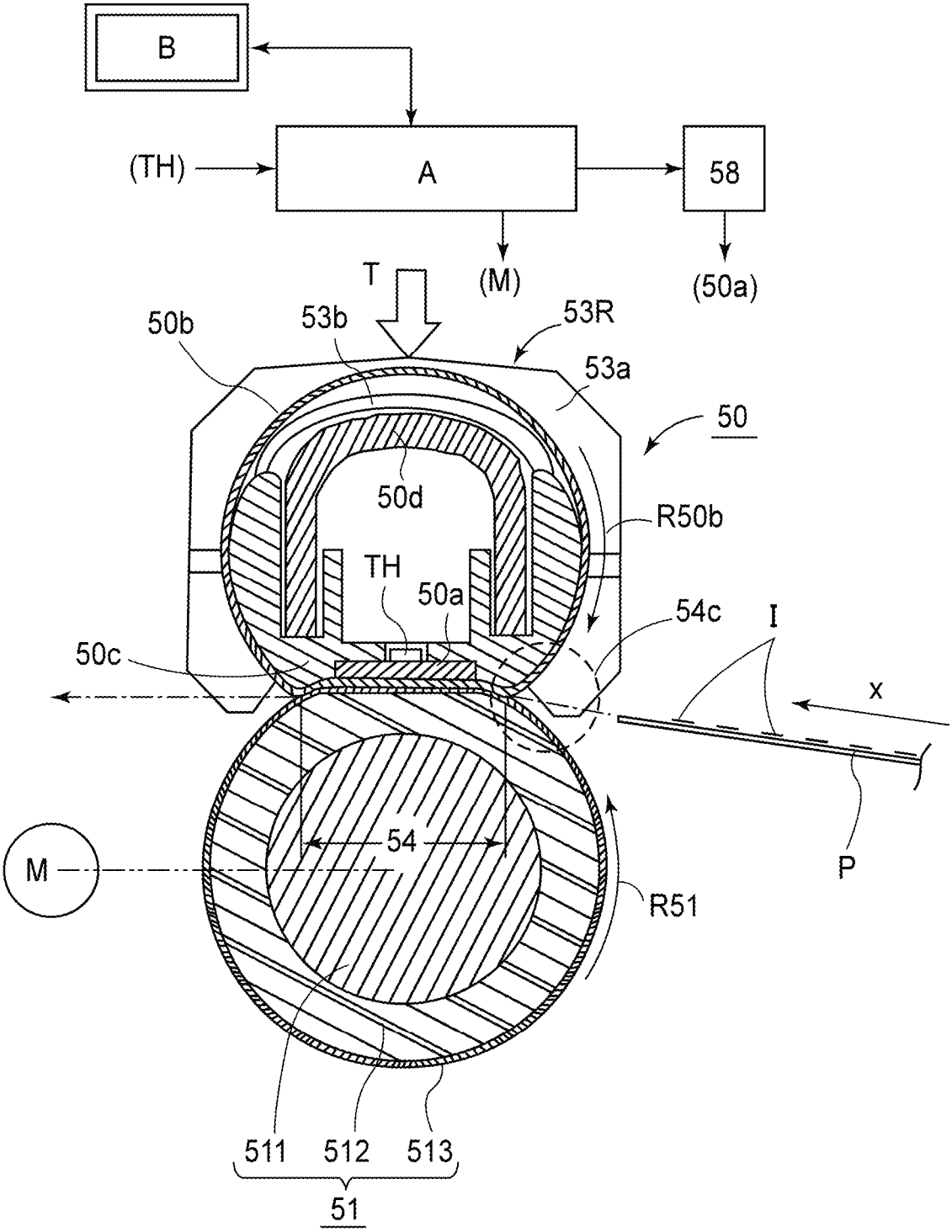
FIG. 4 is an enlarged schematic cross-sectional view of the essential portions of the fixing device.

FIG. 2 is an enlarged schematic sectional view of the fixing apparatus (device), and its adjacencies, of the image forming apparatus 1. FIG. 3(*a*) is an exploded perspective view of the fixing device 5. FIG. 3(*b*) is a perspective view of the second air current blocking component, which is in the state in which it is above the top cover of the casing of the fixing device. FIG. 4 is an enlarged schematic cross-sectional view of the essential portions of the fixing device 5. The fixing device 5 in this embodiment is an image heating device of the so-called heating belt (film) type, and also, of the pressing member driving type. It employs a flat heater 50*a*, such as a ceramic heater, as a heat source (heating system), which is in the form of a long and narrow parallelepiped. A heating device of this type has been known because it was disclosed in various documents, for example, Japanese Laid-open Patent Application H04-44075, and the like.

Regarding the orientation of the fixing device 5, and its structural components, in this embodiment, the "front surface" of the fixing device 5 means the surface of the fixing device 5, which is on the front side when the fixing device 5 is seen from the sheet entrance side of the device, and the "rear surface" of the fixing device 5 means the opposite surface of the device from the front surface, that is, the surface on the sheet exit side of the fixing device 5. The "left (one) or right (other) side" of the fixing device 5 means the left or right side when the fixing device 5 is seen from the front side.

Further, the "upstream and downstream" sides are with reference to the recording medium conveyance direction (sheet conveyance direction). Further, the "length direction (width direction), and sheet width direction" means the direction which is practically parallel to the direction perpendicular to the sheet conveyance direction (sheet conveyance direction). The "width direction" of recording medium means the direction which is practically parallel to the recording paper conveyance direction, at a plane which is parallel to the sheet conveyance passage. The "upward or downward" direction means the upward or downward direction with reference to the gravity direction.

The fixing device 5 in this embodiment is structured so that when a sheet of recording paper is conveyed through the fixing device 5, its center remains coincidental to the center of the recording medium passage in terms of the widthwise direction of the recording medium. However, the present invention is also applicable to a fixing device structured so that when the sheet of recording paper is conveyed through the fixing device 5, one of the edges of the recording medium remains in contact with one of the edges of the recording medium passage, which is parallel to the recording medium conveyance direction.

The fixing device 5 is a long and narrow device. It is disposed in the apparatus main assembly 1A in such a manner that its left and right directions coincide with its lengthwise direction. Roughly speaking, the fixing device 5 is made up of the first (1), second (2), and third units (3), which are a heating unit 50, a pressure roller 51, and a casing 52, respectively. The heating unit 50 has a fixation sleeve 50*b*, which is a rotatable heating component (first rotational component). The pressure roller 51 is rotational pressing component (second rotational component). It is positioned so that its top end is below the rotational axis of the heating unit 50 (fixation sleeve 50*b*), in terms of the gravity direction. The casing 52 encases the heating unit 50 and pressure roller 51. The casing 52 (fixing device 5) is attached to the frame of the apparatus main assembly 1A in such a manner that it is in the preset position in the image forming apparatus 1.

(2-1) Structure of Casing

The casing 52 has a metallic internal frame, which is made up of a base 52B, a top cover 52U, a lateral plate (left lateral plate 52L, and a lateral plate (right lateral plate) 52R. It has a recording paper entrance (sheet entrance) 400, which is on the front side of the casing. It has also a recording paper exit (sheet exit) 500, which is on the rear side of the casing.

The heating unit 50 and pressure roller 51 are disposed between the left and right lateral plates 52L and 52R, with their left and right lengthwise ends being held by the left and right lateral plates 52L and 52R, respectively. The heating unit 50 and pressure roller 51 form a nip 54 between them.

The recording paper entrance 400 is provided with an entrance guide (guiding component) 56A, which is for guiding a sheet P of recording paper to the nip 54 after the sheet P is conveyed to the fixing device 5 from the image formation engine. The entrance guide 56A is fixed to a preset position of the base 52B. As for the recording sheet exit 500, is provided with an exit guide (guiding component) 56B, which is for guiding the sheet P as the sheet P comes out of the nip 54. The exit guide 56B is fixed to the preset position of the base 52B. Further, the recording paper outlet 500 is provided with fixation unit discharge rollers 55*a* and 55*b* (sheet discharging-conveying components), which are for conveying the sheet P by pinching the sheet P between them. The discharge rollers 55*a* and 55*b* are disposed on the downstream side of the exit guide 56B in terms of the recording paper conveyance direction indicated by an arrow mark X.

The fixation unit discharging means 55 has multiple bottom rollers 55*a*, and multiple top rollers 55*b*, which form the nips through which a sheet P of recording paper is conveyed while remaining pinched between each bottom roller 53*a* and corresponding top roller 53*b*. The bottom rollers 55*a* are rotatably disposed in such a manner that a shaft 55*c*, by which the bottom rollers 55*a* are supported, becomes practically parallel to the exit guide 56B. More specifically, there are provided a preset number of bottom rollers 55*a*, which are fixed to the shaft 55*c* with the provision of preset intervals. As for the top rollers 55*b*, a preset number of top rollers 55*b* are rotatably attached to the top cover 52U, in such a manner that they correspond in position to the preset number of bottom rollers 55*a*, one for one, and also, that they are under such pressure that keeps them in contact with the bottom rollers 55*a*, one for one, to form nips.

There is disposed the first air current blocking component (regulating component) 60 in the adjacencies of the recording paper entrance 400, in such a manner that it almost completely blocks the gap between the top cover 52U of the casing 52, and the fixation sleeve 50*b* of the heating unit 50. The first air current blocking component 60 is fixed to the bottom surface of the top cover 52U of the casing 52, or between the left and right lateral plates 52L and 52R. As will be described later, this first air current blocking component 60 is for preventing the air (gas) which contains particles of a preset size, which originate from the parting agent (wax), mostly in the adjacencies of the recording paper entrance 400, from drifting toward the recording paper outlet 500 through the aforementioned gap.

There is disposed the second air current blocking component 61 on the top side of the top cover 52U of the casing 52. Referring to FIG. 3(*b*) which is a perspective view of the second air current blocking component 61 when it is on the top side of the top cover 52U, the second air current blocking component 61 bears the function of causing the abovementioned air current to remain practically stagnant in a closed chamber S, which is vertically above the casing 52, after the air current comes out of the casing 52 through the recording paper entrance 400, which is almost completely blocked by the first air current blocking component 60, as will be described later.

(2-2) Structure of Heating Unit

Figure 5:
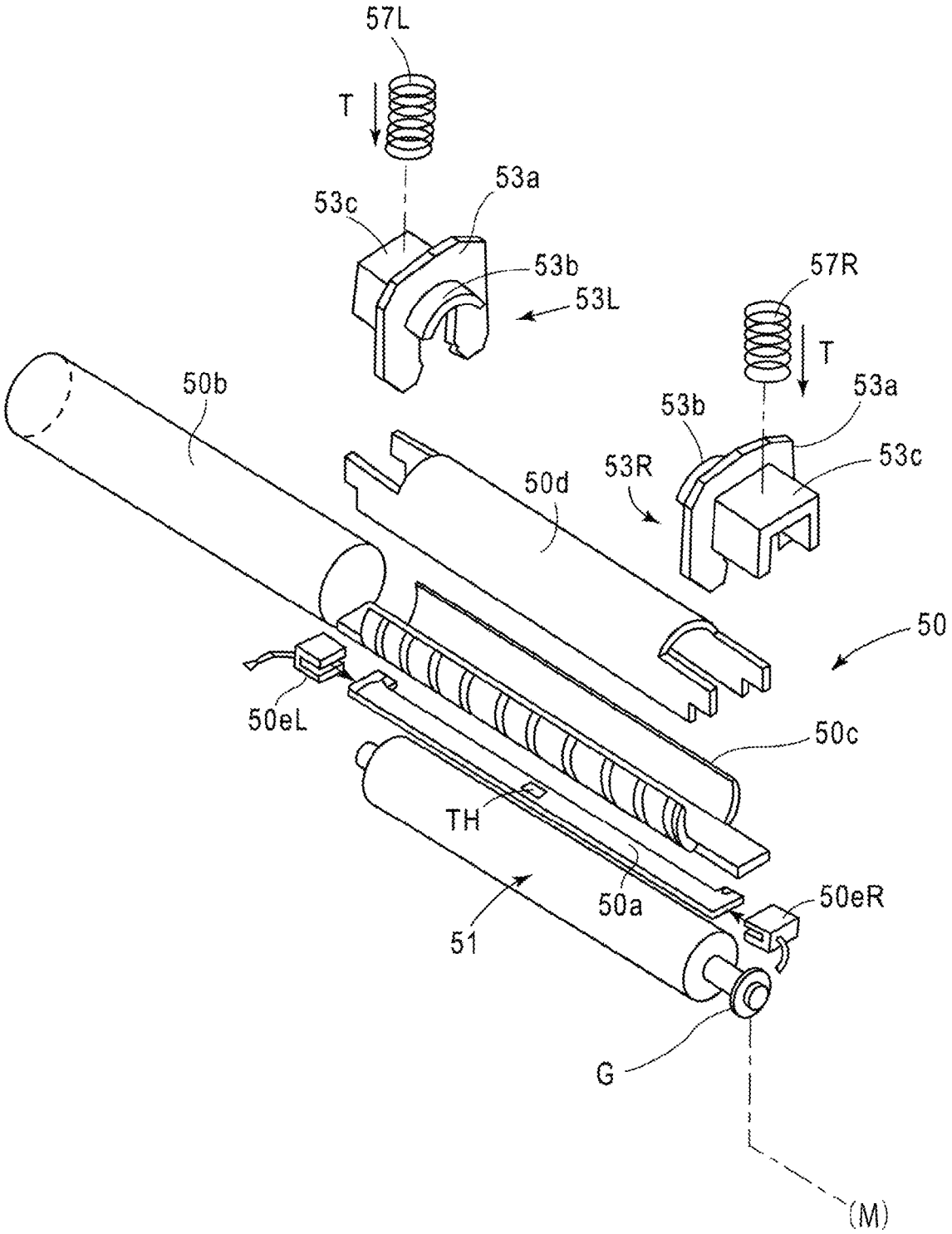
FIG. 5 is an exploded perspective view of the heating unit of the fixing device.

FIG. 5 is an exploded perspective view of the heating unit 50. It includes also the pressure roller 51. The heating unit 50 is an assembly made of an long, narrow, and parallelepipedic heater 50*a*, a fixation sleeve 50*b* (which is an endless belt as a circularly movable component: first rotational component), a heater holder 50*c*, a pressure application stay 50*d*, left and right sleeve flanges 53L and 53R, respectively, etc.

The heater holder 50*c* is a long and narrow component, which is roughly in the shape of a semi-cylindrical trough. It is formed of heat-resistant resin such as liquid polymer. The heater 50*a* is a ceramic heater or the like, and is in the form of a long and narrow parallelepiped. It is small in thermal capacity, and therefore, quickly increases in temperature as electric power is supplied thereto. The heater 50*a* is attached to the downwardly facing surface of the heater holder 50*c*, in such an attitude that it extends in the length direction of the holder 50*c*. The pressure application stay 50*d* is a rigid component, which is U-shaped in cross-section. It is disposed in such an attitude that its open side faces downward. It is formed of a metallic substance such as iron. It is disposed on inwardly facing surface of the heater holder 50*c*. The fixation sleeve 50*b* is loosely fitted around the abovementioned assembly made up of the heater holder 50*c*, heater 50*a*, and pressure application stay 50*d*.

The left and right sleeve flanges 53L and 53R are molded of heat-resistant resin, and are the same in shape. They are symmetrically disposed at the left and right ends, respectively, of the heater holder 50*c*. They hold the fixation sleeve 50*b*. That is, the fixation sleeve 50*b* is held between the left and right sleeve flanges 53L and 53R. More concretely, the left and right end portions of the fixation sleeve 50*b* are rotatably held by the sleeve flanges 53L and 53R, being thereby rotatably held while being controlled in position at its lengthwise ends, and being kept in a preset shape.

(2-2-1) Structure of Fixation Sleeve

Figure 6:
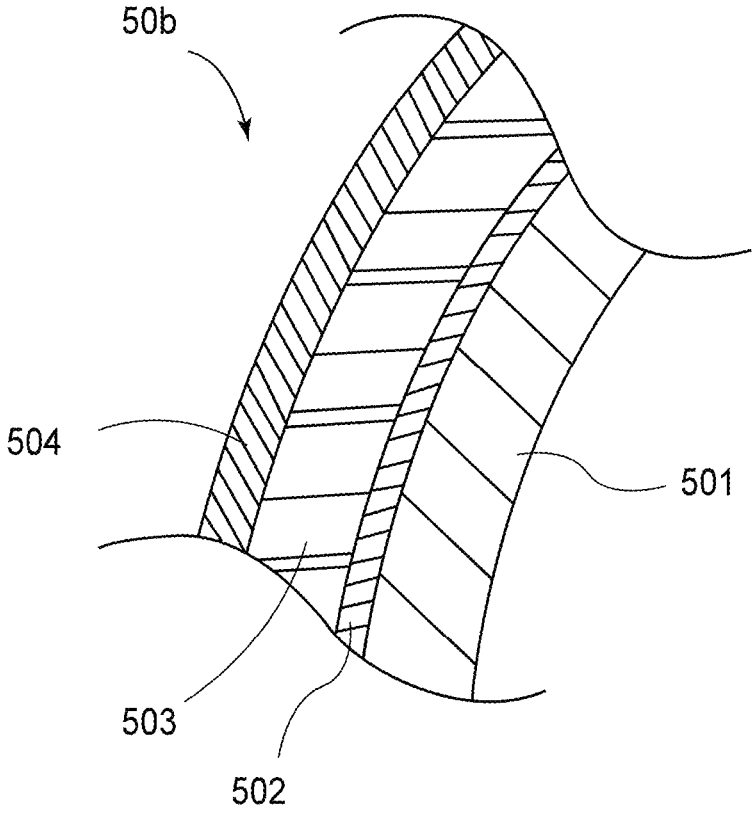
FIG. 6 is a schematic drawing for showing the laminar structure of the fixation sleeve.

FIG. 6 is a schematic drawing for describing the laminar structure of the fixation sleeve 50*b*. The fixation sleeve 50*b* is a multilayer component having an endless (cylindrical) substrative layer 501, a primer layer 502, an elastic layer 503, and a parting layer 504, listing from the inward side of the fixation sleeve 50*b*. The fixation sleeve 50*b* is a thin and flexible component, and is low in thermal capacity.

The substrative layer 501, or the base layer, is made of a metallic substance such as SUS (stainless steel). In order to enable the substrative layer 501 to withstand thermal stress as well as mechanical stress, the substrative layer 501 is given a thickness of roughly 30 μm. The primer layer 502 is roughly 5 μm in thickness. It is coated on the substrative layer 501.

When a toner image is compressed upon a sheet P of recording paper, the elastic layer 503 elastically deforms to play the role of keeping the parting layer 504 airtightly in contact with the toner image. The parting layer 504 is for preventing toner particles, paper dust, and the like from adhering to the fixation sleeve 50*b*. It is formed of PFA resin which is excellent in parting properties and heat resistance. For thermal conductivity, the thickness of the parting layer 504 is made to be roughly 20 μm in thickness.

(2-2-2) Structure of Sleeve Flange

Each of the sleeve flanges 53L and 53R has a flange section 53*a*, a rack section 53*b*, and a pressure bearing section 53*c*. The flange section 53*a* is the section for catching the fixation sleeve 50*b* by the edge of the fixation sleeve 50*b* to regulate the movement of the fixation sleeve 50*b* in the thrust direction of the fixation sleeve 50*b*. In terms of the diameter direction of the fixation sleeve 50*b*, the dimension of the flange section 53*a* is greater than that of the fixation sleeve 50*b*. The rack section 53*b* is on the inward side of the flange section 53*a*, and is roughly semi-cylindrical in cross-section. It holds the fixation sleeve 50*b* from within the fixation sleeve 50*b* to keep the fixation sleeve 50*b* cylindrical in shape. The pressure bearing section 53*c* is on the outward side of the flange section 53*a*, and bears the pressure T generated by a pressure applying means 57L or 57R such as a compression spring.

(2-3) Structure of Pressure Roller

Referring to FIG. 4, the pressure roller (pressure applying rotational component: second rotational component) 51 is an elastic roller. It has a metallic core 511 formed of aluminum, iron, or the like, an elastic layer 512 formed of silicon rubber or the like, and a parting layer 513 which covers the elastic layer 512. The parting layer 513 is formed by covering the elastic layer 512 with a piece of tube made of fluorinated resin such as PFA resin.

The pressure roller 51 is supported between the left and right lateral plates 52L and 52R of the casing 52; the left and right end of the metallic core 511 are rotatably supported by the left and right lateral plates 52L and 52R, with the placement of a pair of bearings (unshown) between the metallic core 511 and lateral plates 52L and 52R, one for one.

The heating unit 50 is disposed between the left and right lateral plates 52L and 52R, practically in parallel to the pressure roller 51, on the top side of the pressure roller 51, in such an attitude that its surface having the heater 50*a* faces the pressure roller 51.

Here, each of the left and right lateral plate plates 52L and 52R is provided with a guiding hole 521 (FIGS. 3(*a*) and 3(*b*)), which extends toward the pressure roller 51. The left and right ends of each of the sleeve flanges 53L and 53R are fitted in the corresponding guiding holes 521, one for one, in such a manner that they are allowed to slide toward or away from the pressure roller 51 along the guiding holes 521. Further, the left and right ends of each of the sleeve flanges 53L and 53R are under a preset amount of pressure T generated by a pressure applying means 57L (57R) (FIG. 5) in the direction to keep the sleeve flanges 53L and 53R pressed toward the pressure roller 51.

With the presence of the above described pressure T, the entirety of the heating unit 50, that is, the combination of the sleeve flanges 53L and 53R, pressure application stay 50*d*, heater holder 50*c* heater 50*a*, and fixation sleeve 50*b* moves toward the pressure roller 51 whenever it is allowed. Therefore, the heater 50*c* is kept pressed against the pressure roller 51 by the preset amount of pressure T, with the presence of the fixation sleeve 50*b* between the heater 50*a* and pressure roller 51, and also, against the elasticity (resiliency) of the elastic layer 512. Therefore, the nip 54 (FIG. 4) having a preset width, in terms of the recording paper conveyance direction X, is formed and maintained between the fixation sleeve 50*b* and pressure roller 51.

(2-4) Fixation Sequence

The operation (fixation sequence) of the fixing device 5 is as follows: The control circuit A rotationally drives the pressure roller 51 in the rotational direction indicated by an arrow mark R51 in FIG. 4, at a preset speed, with a preset control timing. More specifically, the pressure roller 51 is rotationally driven by the driving force transmitted to a gear G (FIG. 5), which is an integral part of the pressure roller 51, from a driving force source M, which is under the control of the control circuit A.

As the pressure roller 51 is rotationally driven, torque applies to the fixation sleeve 50*b*, in the nip 54, because of the friction between the fixation sleeve 50*b* and pressure roller 51. Therefore, the fixation sleeve 50*b* circularly rotates around the pressure application stay 50*d* in the rotational direction R50*b*, at roughly the same speed as the pressure roller 51, with the inward surface of the fixation sleeve 50*b* airtightly sliding on the heater 50*a*.

The driving force from the driving force source M is transmitted to also the shaft 55*c* of the bottom roller 55*a* of the discharge roller unit 55. Thus, the bottom roller 55*a* rotates in the direction indicated by an arrow mark R55*a* in FIG. 2, at a preset speed. As for the top roller 55*b*, it is rotated by the rotation of the bottom roller 55*a* in the direction indicated by an arrow mark R55*b*.

Further, the control circuit A begins to supply the heater 50*a* with the electric power from an electric power source 58, through a pair of power supply connectors 50*e*L and 50*e*R (FIG. 5) with which the left and right ends of the heater 50*a* are fitted, respectively. As the power supply begins to be supplied to the heater 50*a*, the heater 50*a* quickly increases in temperature across its entire range. This increase in temperature is detected by a thermistor TH, as a temperature detecting means, which is located on the rear side (opposite side from nip 54) of the heater 50*a*.

Based on the heater temperature detected by the thermistor TH, the control circuit A controls the amount by which electric power is supplied to the heater 50*a* from the electric power source 58, in such a manner that the heater temperature reaches a preset target level, and remains at the target level. In this embodiment, the target temperature level is roughly 180° C.

Then, a sheet P of recording paper, on which an unfixed toner image is present, is introduced into the fixing device 5 from the image formation engine side, while being guided by the recording paper entrance guide 56A, in such an attitude that the surface of the sheet P, on which the unfixed toner image I is present, faces upward, and the opposite surface (back surface) of the sheet P from the surface having the unfixed toner image, faces downward. Then, the sheet P is conveyed through the nip 54 while remaining pinched by the fixation sleeve 50*b* and pressure roller 51. While the sheet P is conveyed through the nip 54, the fixation sleeve 50*b* contacts the surface of the sheet P, on which the unfixed toner image I is present.

While the sheet P is conveyed through the nip 54, remaining pinched by the fixation sleeve 50*b* and pressure roller 51, the heat from the heater 50*a* is given to the sheet P, and the unfixed toner image I on the sheet P. Thus, the unfixed toner image I is melted by the heat from the heater 50*a*, while remaining under the pressure applied to the nip 54. Thus, the unfixed toner image I is thermally fixed to the sheet P. After being conveyed out of the nip 54, the sheet P is guided by the recording paper exit guide 56B, and is discharged out of the fixing device 5 through the recording paper outlet 500 by way of the pair of discharge rollers 55.

(3) Parting Agent Contained in Toner

Next, the parting agent contained in the toner I is described. In this embodiment, the parting agent is wax. It is possible that the so-called offset phenomenon that the toner I transfers onto the fixation sleeve 50*b* will occur during the fixation. This phenomenon is problematic in that its results in the formation of defective images.

In this embodiment, therefore, the toner I is made to contain wax. That is, the toner I is concocted so that the wax oozes out of the toner I during the fixation. As the wax oozes out, it remains in the interface between the fixation sleeve 50*b* and the toner image I on a sheet P of recording paper, making it possible to prevent the occurrence of the offset phenomenon (ensure that toner I separates from fixation sleeve 50*b*).

Incidentally, hereafter, any of chemical compounds, such as those created by causing a substance having hydrocarbon chain, which is similar in molecular structure to wax, to react with the molecules of the resinous component of the toner, which are similar in molecular structure to wax, is also referred to as wax. By the way, substances other than wax can be used as the parting agent. For example, silicone oil and the like, which has a parting function, may be used in place of wax.

In this embodiment, paraffin wax was used, the melting point Tm of which was roughly 75° C. That is, the melting point Tm was set to ensure that when the temperature of the nip 54 is kept at 180° C., the wax in the toner I instantly melts and oozes out into the interface between the toner image and fixation sleeve 50*b*.

As the wax melts, some of its components, etc., which are low in molecular weight, vaporize (volatilize). Wax is made up of long-chain molecules, which are not the same in length. That is, the long-chain molecules of which wax is made up displays a certain pattern in terms of molecule size distribution. In other words, wax contains components which are short in chain length, being therefore small in molecular weight, and low in boiling point, and components which are long in chain length, being therefore large in molecular weight, and high in boiling point. Thus, it is thought that as wax melts, its low molecular weight components vaporize.

As the components of wax vaporize into the ambient air, they are cooled by the air. As they are cooled, they condense into microscopic particles (dust particles), which are several nanometer to several hundreds of nanometer in size. These microscopic particles can remain airborne. However, most of them are thought to be several nanometers to several tens of nanometer in particle diameter.

This dust is wax in origin, being therefore adhesive. Therefore, it is possible that it creates problems by adhering to various internal portions of the image forming apparatus 1. For example, if the dust contaminates the fixation unit discharge rollers 55 and/or discharge rollers 15 by solidly adhering and/or accumulating thereon, it is possible that the dust transfers onto a sheet P of recording paper, which will affect the image forming apparatus 1 in image quality. Further, it is possible that the dust will clog a filter 59 (FIG. 1), with which the exhausting system (cooling system) of the image forming apparatus 1, which is for exhausting the ambient air of the fixing device 5, is provided, by adhering to the filter 59.

(4) Microscopic Particles (Dust) which are Traceable to Parting Agent and are Generated During Fixation It was revealed by the researches conducted by the inventors of the present invention that most of wax components (parting agent components) which vaporized during the fixation, and then, condensed, remain airborne in the adjacencies (FIGS. 2 and 4) of the recording paper entrance 400 (nip entrance 54*c*) of the fixing device 5. It was also revealed that the phenomenon that the microscopic particles resulting from the condensation of the vaporized wax components (dust) turn into particles of larger size by colliding with each other, is exacerbated in the adjacencies the recording paper entrance 400 (nip entrance 54*c*) of the fixing device 5. Next, this phenomenon is described in detail.

(4-1) Properties of Dust, and where Dust is Generated

Figure 7:
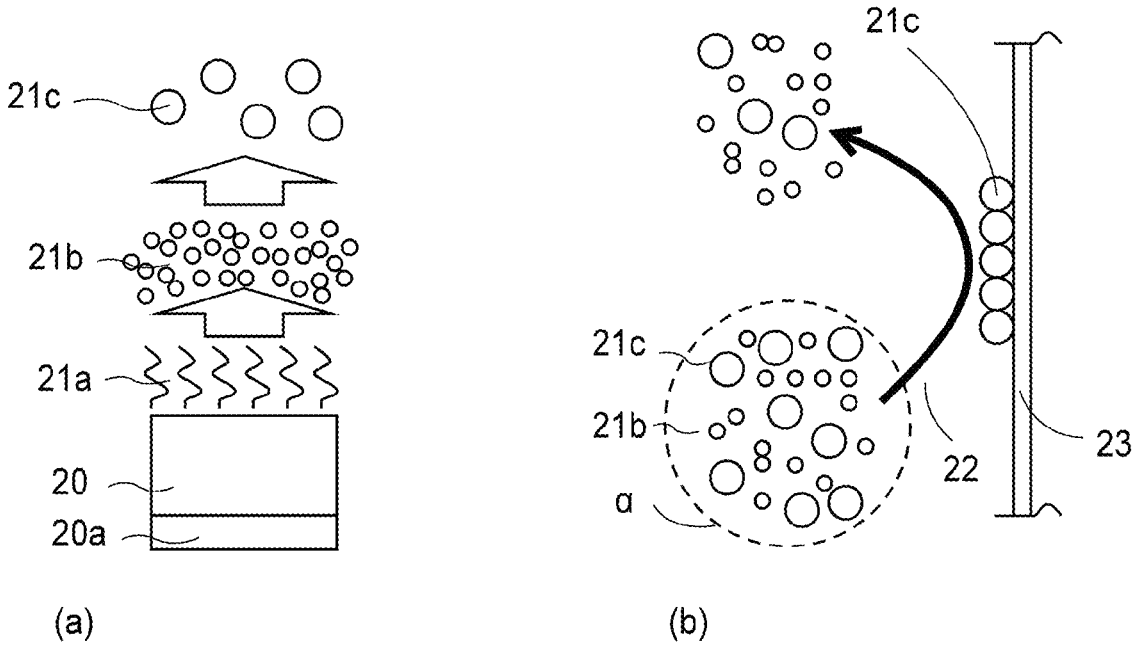
FIG. 7 is a drawing for illustrating how the hypothetical microscopic dust particles (wax particles) coalesce into larger dust particles, and then, adhere to the surfaces of adjacent objects.

It has been known that the dust attributable to the parting agent (wax) tends to coalesce, and therefore, increase in size, and also, that it tends to adhere to solid objects which are in the ambience in which it is airborne. FIGS. 7(*a*) and 7(*b*) are drawings for describing these characteristics of the dust.

Referring to FIG. 7(*a*), as a substance 20 which is high in boiling point (150-200° C.) is heated to roughly 200° C. while it is kept on the heat source 20*a*, the volatile components 21*a* of the substance 20 vaporize. As the vaporized volatile components 21*a* come into contact with the ambient air, their temperature immediately falls below their boiling point. Consequently, they condense in the ambient air, turning thereby into microscopic particles (dust particles) 21*b*, which are roughly several nanometer to several tens of nanometer in particle size. This phenomenon is the same as the phenomenon that as water vapor reduces in temperature below the dew-point, its turns into numerous microscopic water droplets, which forms fog.

It has been known that the dust particles 21*b* continuously move (Brownian motion), and therefore, they collide with each other, and coalesce into dust particles 21*c* which are larger in particle size than dust particles 21*b*. The greater the dust particles 21*b* in movement, in other words, the higher in temperature the ambient air, the greater the amount by which this phenomenon is exacerbated. Further, this coalescence of the dust particles 21*b* gradually slows down as the size of the dust particles 21*c* becomes greater than a certain value, which is thought to occur because as the dust particles unite into larger particles, they reduce in Brownian movement, and therefore, move less in the air.

Next, referring to FIG. 7(*b*), it is assumed here that an air mass α which contains the dust particles 21*c* which are larger in size than the microscopic dust particles 21*b* drift toward the wall 23 along with the airflow 22. During this movement of the air mass α, the larger dust particles 21*c* are more likely to adhere to the wall 23, and therefore, are less likely to disperse, than the smaller dust particles 21*b*, because the larger dust particles 21*c* are greater in inertia, being therefore likely to collide into the wall 23 at a higher speed, than the smaller dust particles 21*b*.

This phenomenon occurs also when the air current speed is no more than 0.2 m/s, which is less than the lowest air current speed measurable by an anemometer, that is, when the air current is extremely slow. Therefore, the greater (in particular, several hundreds of nanometer) the particle size into which the dust particles 21*b* are turned, the greater the amount by which the dust particles 21*b* will remain in the fixing device 5 (mostly adhere to fixation sleeve), and therefore, the more effectively they can be prevented from dispersing out of the fixing device 5.

As described above, the dust particles have two characteristics, that is, the characteristic that they coalesce into larger dust particles, and the characteristic that as they increase in size, they are likely to adhere to adjacent objects. By the way, how easily dust particles unite with each other is dependent upon the ingredient, temperature, and particle density of the dust. For example, as the ambient temperature increase, the dust particles increase in temperature, and therefore, their components are likely to become more adhesive, being therefore more likely to cause the dust particles to coalesce with each other. Further, as the dust particles increases in density, they increases in the probability with which they collide with each other, being therefore more likely to collide with each other, and therefore more likely to coalesce. That is, by increasing the dust particles in size, it is possible to prevent the microscopic dust particles (those which are present immediately after condensation) from dispersing out of the fixing device 5.

Figure 8:
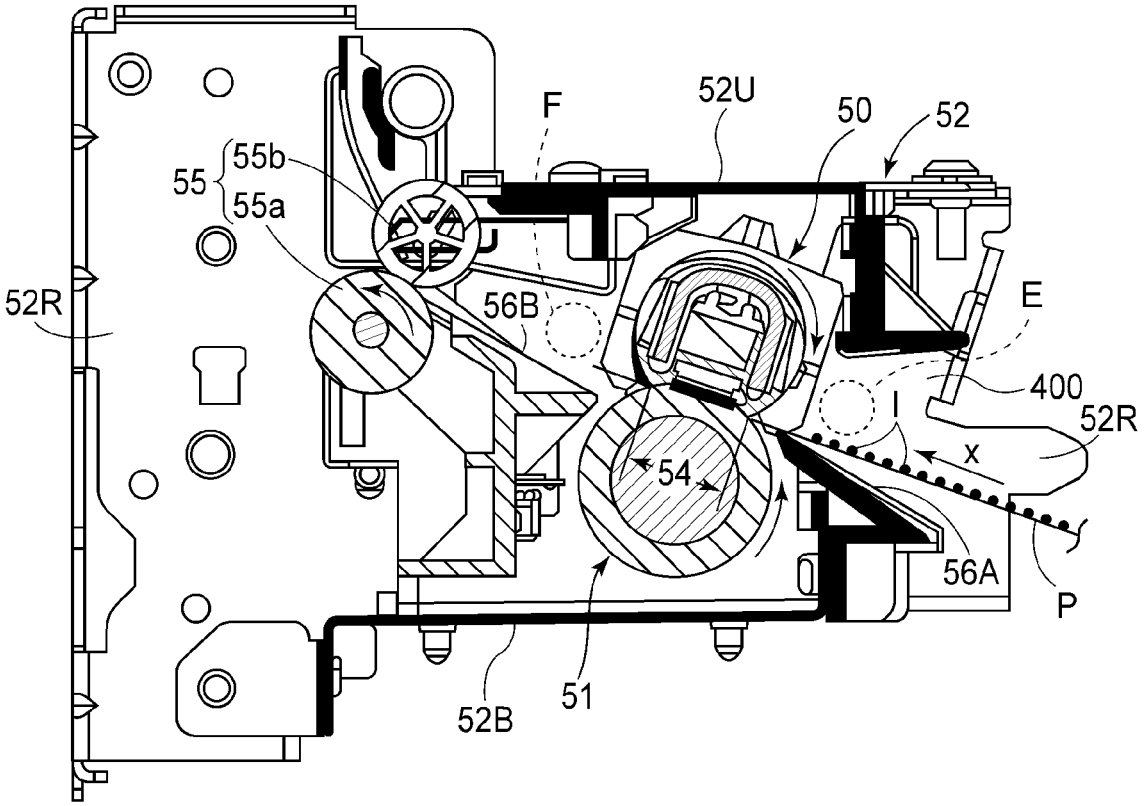
FIG. 8 is a schematic drawing for illustrating where the dust generates.
Figure 9:
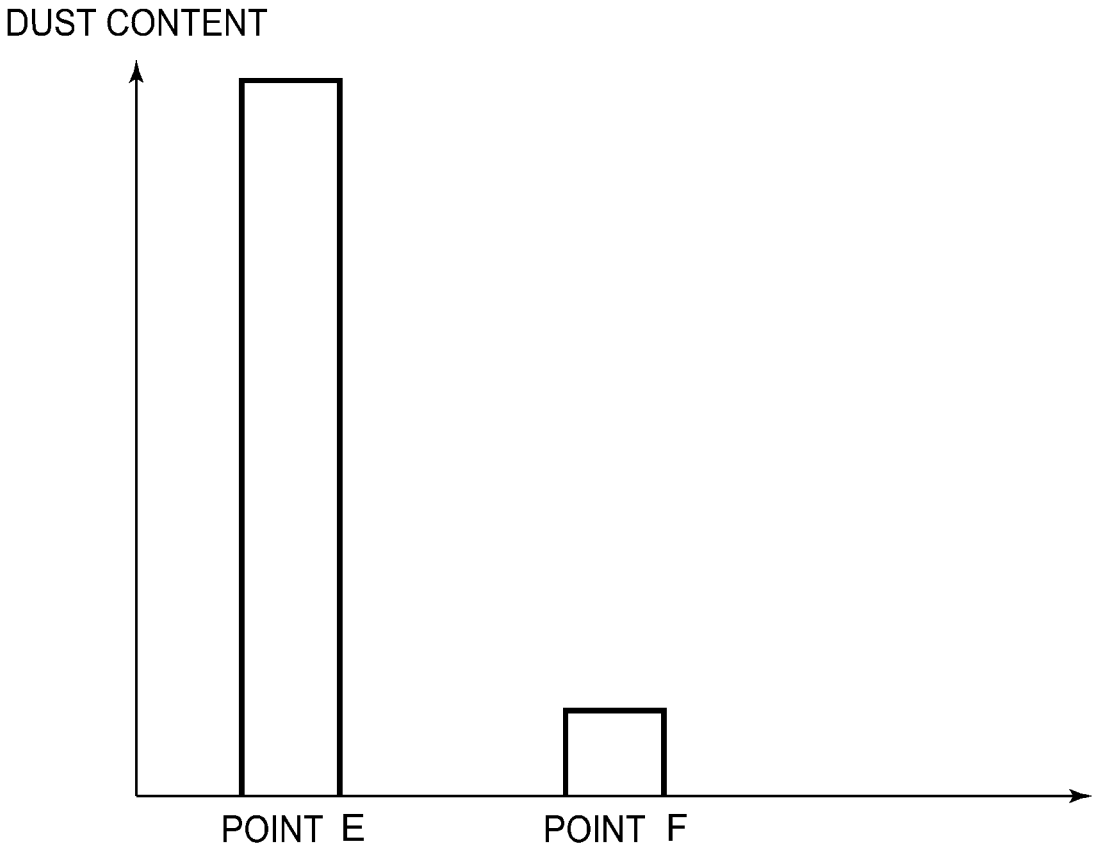
FIG. 9 is a graph which shows the dust density in the adjacencies of the fixation sleeve.

Next, referring to FIGS. 8 and 9, it is described where the dust is generated. FIG. 8 is different from FIGS. 2 and 4 in that it shows the state of the fixing device 5, in which a sheet P of recording paper, on which the toner image I is present, is being conveyed through the nip 54 while remaining pinched by the fixation sleeve 50*b* and pressure roller 51, in other words, the state of the fixing device 5, in which the dust particles are airborne. By the way, the image forming apparatus 1 shown in FIG. 8 does not have the first air current blocking component 60 and second air current blocking component 61, which the fixing device 5 shown in FIG. 2 was provided.

When dust density was measured at points E and F, which are in the adjacencies of the entrance and exit sides, respectively, of the nip 54, while the fixing device 5 is in the state shown in FIG. 8, the point E was conspicuously higher in dust particle density than the point F, as shown in FIG. 9. The instrument used to measure the dust particles density was a fast mobility particle sizer FMPS (product of TSI (U.S.A.) Co., Ltd.).

This fast mobility particle sizer (FMPS) is capable of measuring numerical density (count/$cm^3$), weight density (μg/$m^3$). In this embodiment, the numerical density of the dust particles, the size of which is in a preset range, that is, which are no less than 6 nm and no more than 560 nm in particle size, was used as the dust density.

This result indicates that where the dust is generated is the adjacencies of the recording paper entrance 400 (entrance of nip 54*c*) of the fixing device 5. It seems reasonable to think that the reason for this estimation is that as the fixation sleeve 50*b* comes into contact with the toner image I when the fixation sleeve 50*b* is high in temperature, the wax components which are small in molecular weight instantly vaporize, and therefore, they will have completely vaporized by the time they come out of the nip 54.

(4-2) Measures for Dealing with Dust

Thus, the fixing device 5 in this embodiment is provided with the air current blocking component (regulating component) 60, which is placed in the adjacencies of the recording paper entrance 400 (nip entrance 54*c*), in such a manner that it almost completely seals the gap between the fixation sleeve 50*b* and top cover 52U in the casing 52. Further, it is provided with the second air current blocking component 61, which is positioned above the top cover 52U to fill the gap between the fixing device 5 and apparatus main assembly 1A (portion of apparatus main assembly, which are in the adjacencies of fixing device). With the provision of the two air current blocking components 60 and 61, it is possible to prevent the dust from scattering in the image forming apparatus 1.

Figure 10:
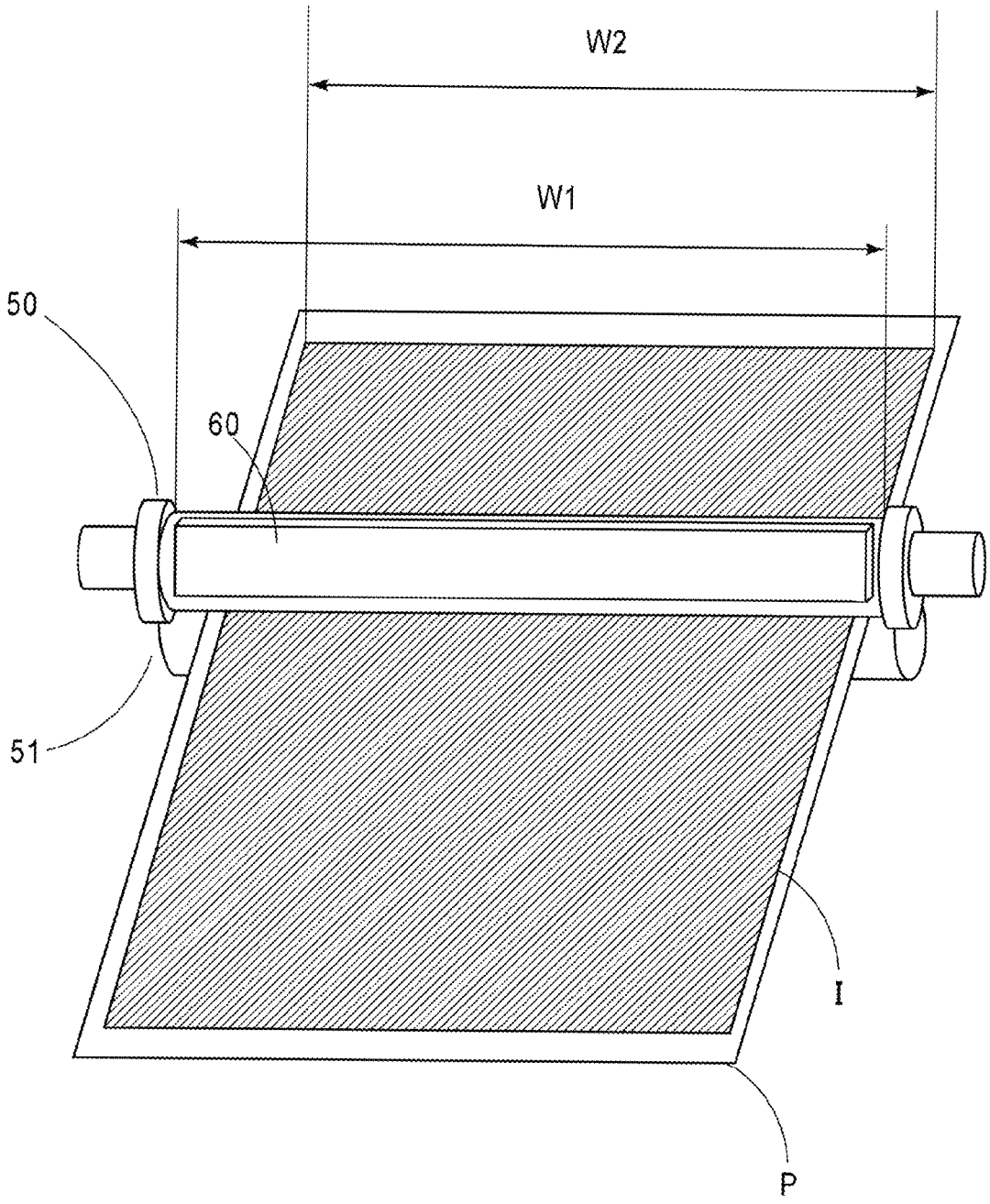
FIG. 10 is a drawing for illustrating the relationship between the width of the toner image path and the width of the first air current blocking component.

FIG. 10 is a schematic perspective view of the heating unit 50, pressure roller 51, and first air current blocking component 60 of the fixing device 5. The other components of the fixing device 5 than the preceding structural components of the fixing device 5, such as the components of the casing 52, second air current blocking component 61, etc., are not shown in FIG. 10.

The width W1 of the first air current blocking component 60, in terms of its length direction is desired to be set to so that it becomes greater than the width W2 of the path of the toner image I on a sheet P of recording paper. Incidentally, the width W2 is equivalent to the width of the area of the widest sheet of recording paper sheet P, usable with the image forming apparatus 1, across which the toner image I is formable. Thus, the positional relationship between the first air current blocking component 60 and fixation sleeve 50*b* is such that the first air current blocking component 60 extends outward beyond the area across which the fixation sleeve 50*b* can contact the toner image I, in terms of the width direction of the first air current blocking component 60.

However, if the frequency with which the image forming apparatus 1 is used with the widest sheet P of recording paper is relatively small, the problems with which the present invention is concerned can be satisfactorily solved, even if the width W2 is made less than the abovementioned value. In such a case, however, it is appropriate to set the width W2 to the value of the width of the largest toner image I formable on a sheet P of recording medium which is highest in the frequency of usage, from the standpoint of reducing the apparatus in size.

Figure 11:
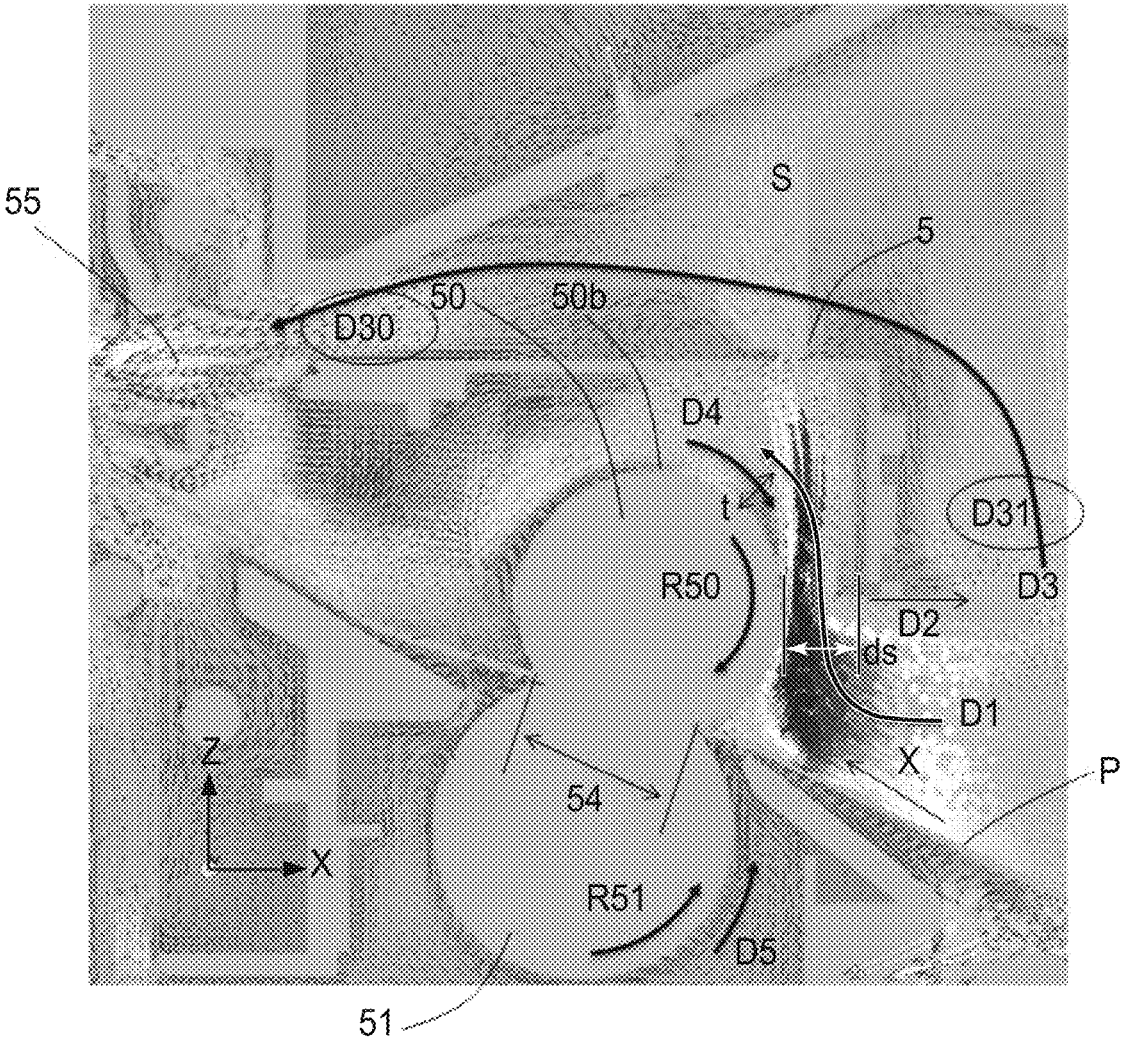
FIG. 11 is a sectional view of the fixing device and its adjacencies, which is for analytically showing the thermal air current in the adjacencies of the fixing device.

FIG. 11 is a schematic sectional view of the fixing device 5, and its adjacencies. It is for the analysis of thermal air current. It is about a fixing device 5, which is not provided with the first and second air current blocking components 60 and 61, unlike the fixing device 5 shown in FIG. 8.

A large number of lines in the drawing show the likely routes for the air current. The routes indicated by arrow marks D1, D2, D3, D4 and D5 are the likely routes which the essential air currents in the apparatus main assembly 1A would take. The air current in the adjacencies of the fixing device 5 becomes largest in the adjacencies of the recording paper entrance 400 when a sheet P of recording paper enters the nip 54. During this movement of the sheet P, virtually no air current flows downward of the pressure roller 51; air current flows upward (route D1) of the fixation sleeve 50*b*. The portion of the air current, which fails to flow upward of the heating unit 50, flows in the opposite direction (route D2) from the recording paper conveyance direction X.

Further, the temperature of the fixation sleeve 50*b* will have increased to roughly 180° C. Therefore, the temperature of the closed space (closed chamber) S which is vertically directly above the fixing device 5, increases to roughly 60° C. While the temperature of this closed space S increases in temperature, updraft (upward air current) is generated (route D3). The route D1 begins in the adjacencies of the recording paper entrance 400 (nip entrance 54*c*) of the fixing device 5 (entry portion of route D31), extends on the top side of the fixing device 5, and extends further to adjacencies (air exhaust opening D30) of the fixation unit discharge rollers 55.

There are also routes D4 and D5 (air currents D4 and D5), in the adjacencies of the peripheral surface of the fixation sleeve 50*b* and the peripheral surface of the pressure roller 51, through which air current flows in the directions indicated by arrow marks R50 and R51, respectively, which are parallel to the direction of the rotation of the fixation sleeve 50*b* and pressure roller 51. That is, the likely routes through which the dust which is generated in the adjacencies of the recording paper entrance 400 (nip entrance 54*c*) flows include: the route D1 through which the dust disperses into the image forming apparatus 1 by way of the top side of the heating unit 50. They include also the routes D2 and D3 through which the dust moves on the top side of the fixing device 5, and scatters in the image forming apparatus 1.

Figure 12:
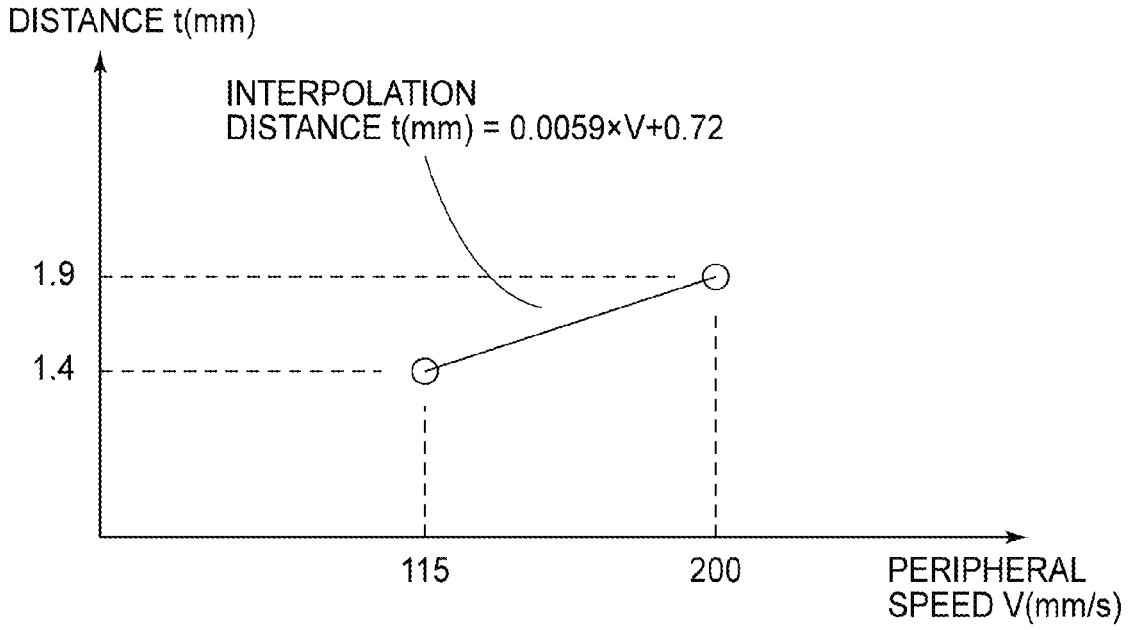
FIG. 12 is a graph which shows the distance t obtained by simulation.

FIG. 12 shows the relationship between each of the peripheral velocity of the fixation sleeve 50*b* and that of the pressure roller 51, and a distance t. There is a gap (distance t) in which no dust is present, between the fixation sleeve 50*b* and the route D1. The area which is apart from the fixation sleeve 50*b* by the distance t is the borderline between the routes D1 and D4. The inward side of this borderline is where dust-free air is sent toward the recording paper entrance 400 (nip entrance 54*c*). The outward side of this borderline is where the dust which was generated at the recording paper entrance 400 (nip entrance 54*c*) is present.

Referring to FIG. 12, the distance t is dependent upon the peripheral velocity V. Thus, it may be reasonable to guess that the greater the peripheral velocity V, the stronger the effect of the route D4, that is, the greater (wider) the distance t.

In order to keep the dust confined in the adjacencies of the recording paper entrance 400 (nip entrance 54*c*), it is necessary to almost completely block the route D1. A referential code dS stands for the gap between the first air current blocking component 60 and fixation sleeve 50*b* (FIG. 2). Thus, in order to almost completely block the route D4, it is necessary to make the gap dS as small as possible (as close as possible to zero). The reason why it should not be completely blocked will be given later).

One of the practical methods for setting a value for the gap dS is the one which uses FIG. 12. The distance t in FIG. 12 is the distance from the borderline between the route D1 and route D4, to the fixation sleeve 50*b*. Therefore, in a case where the peripheral velocity V is within a range of 115-200 mm/s, the value for the gap dS has only to be set so that the following inequity can be satisfied:

$$0.5 \leq dS(\text{mm}) \leq 0.0059 \times V + 0.72.$$

The reason why the bottom limit was set to 0.5 mm is to prevent the fixation sleeve 50*b* and first air current blocking component 60 from coming into contact with each other. As described above, these components are formed of PFA resin. Therefore, their surfaces are easily scarred by the contact between them. If their surfaces are scarred, the presence of the scar will affect the image forming apparatus 1 in image quality. Further, in consideration of the component tolerance and thermal deformation of components, it is extremely difficult to make the gap dS smaller than 0.5 mm, from the standpoint of design. This is why the bottom limit for the gap dS was set to 0.5 mm.

By the way, the above described method is based on a presumption that the route D1 is to be almost completely blocked. In reality, however, in practical terms, as long as a part of the route D1 is blocked, the dust dispersion can be prevented.

Thus, a method which measures the dust density in the adjacencies of the fixation unit discharge rollers 55, which correspond in position to the exit of the dust flow, with the use of a fast motion particle sizer (FMPS), in order to evaluate the effects of the first air current blocking component 60, is more practical.

For example, it is recommendable to reduce the gap dS in steps, starting from 4.0 mm (4 mm→3.5 mm→3.0 mm→2.5 mm→2.0 mm→1.5 mm), and then, choose the value at which the dust density in the adjacencies of the fixation unit discharge rollers 55, begins to reduce. As for the standard for determining whether or not the dust density begins to reduce, it should be no more than ⅔ of the dust density in the adjacencies of the fixation unit discharge rollers 55 of a fixing device which does not have the first air current blocking component 60. Dust particles are less dispersive than gas molecules. Therefore, local dust density is likely to be easily affected by the air current disturbance which is caused by the conveyance of a sheet P of recording paper through the fixing device 5, or the like event.

According to the experiences of the inventors of the present invention, the local dust density varied within a range of ±30%. Therefore, the evaluation standard was set to a value which is no more than ⅔. In this embodiment, when the gap dS was set to 2.0 mm, the dust density in the adjacencies of the fixation unit discharge rollers 55 fell below ⅔, and therefore, it was possible to prevent the problems caused by the contamination attributable to the wax dust.

It is desired that the first air current blocking component 60 is placed no less than 0.5 mm and no more than 3.5 from the peripheral surface of the fixation sleeve 50*b*. That is, it is desired that the gap dS between the peripheral surface of the fixation sleeve 50*b* and first air current blocking component 60 is no less than 0.5 mm and no more than 3.5 mm, for the following reason. That is, with the employment of this setup, the dust density in the adjacencies of the fixation unit discharge rollers 55 can be reduced by no less than 70%, compared to one measured when the first air current blocking component 60 was not provided. That is, as long as a part of the air current route D1 (FIG. 11) can be blocked by the first air current blocking component 60, the problems attributable to the wax dust can be reduced to a practically ignorable level.

By the way, the reason why the bottom value was set to 0.5 mm is that if the first air current blocking component 60 is placed too close to the fixation sleeve 50*b*, it is possible that the first air current blocking component 60 will come into contact with the fixation belt 105.

However, if the route D1 is blocked with the provision of the first air current blocking component 60 as described above, it cannot be avoided that the route D2 is increased in the amount of air current. In a case where the dust cannot be kept confined in the adjacencies of the recording paper entrance 400 (nip entrance 54*c*), the dust scatters into the image forming apparatus 1 through the route D3. Therefore, in order to prevent the dust from widely dispersing into the image forming apparatus 1, the dust should be kept confined in the closed space S, and also, the dust particles should be made to adhere to the walls of the closed space S.

There is in the adjacencies of the fixing device 5, the upward air current which is generated by the temperature increase of the fixation sleeve 50*b* and moves toward the space S (route D3). Therefore, in order to ensure that the upward air current moves toward the space S, not only an air current entrance D31, but also, an air current outlet D30, are necessary. In addition, in order to facilitate the adhesion of dust particles, the air current outlet D30, which is smaller than the air current entrance D31 of the route D3, is necessary, for the following reason.

That is, with the provision of the air current outlet D30, which is smaller than the air current entrance D31, the air current outlet D3 is increased in air current speed. In other words, the dust particles are increased in inertia, and therefore, more likely to adhere to the adjacencies of the air current outlet D30. Therefore, it is desired that the air current flows out through the air current outlet D30 by a certain amount, and the air current outlet D30 is faster in air current speed than the air current entrance D31.

In this embodiment, the air speed in the air current entrance D31 was 0.12 m/s. With the air current outlet D30 being smaller in size, the air speed in the air current outlet D30 increased from 0.67 m/s to 3.02 m/s. Thus, the amount of dust dispersion on the downstream side of the air current outlet D30 was reduced by 40%. That is, with the air current outlet D30 being smaller than air current entrance D31, the air current outlet D30 was increased in air speed, and therefore, facilitated dust adhesion. Therefore, it was possible to prevent the dust from scattering in the image forming apparatus 1.

As described above, the first air current blocking component 60 keeps the dust which was generated in the nip 54, confined in the adjacencies of the nip. Further, not only is the dust prevented by the first air current blocking component 60 from moving toward the sheet discharge opening, but also, it is made to flow out of the casing through the sheet entrance. Then, the dust rides on the updraft toward the closed space S, being thereby guided into the closed space S. After being guided into the closed space S, the dust is increased in velocity by the air current exit which is very small in cross section, collides with, and adheres to, the upstream portion of the exit opening of the closed space S. The closed space S is not within the recording paper passage, and therefore, it can prevent the dust from adhering to a sheet P of recording paper, after the dust accumulates in the closed space S.

Embodiment 2

Figure 13:
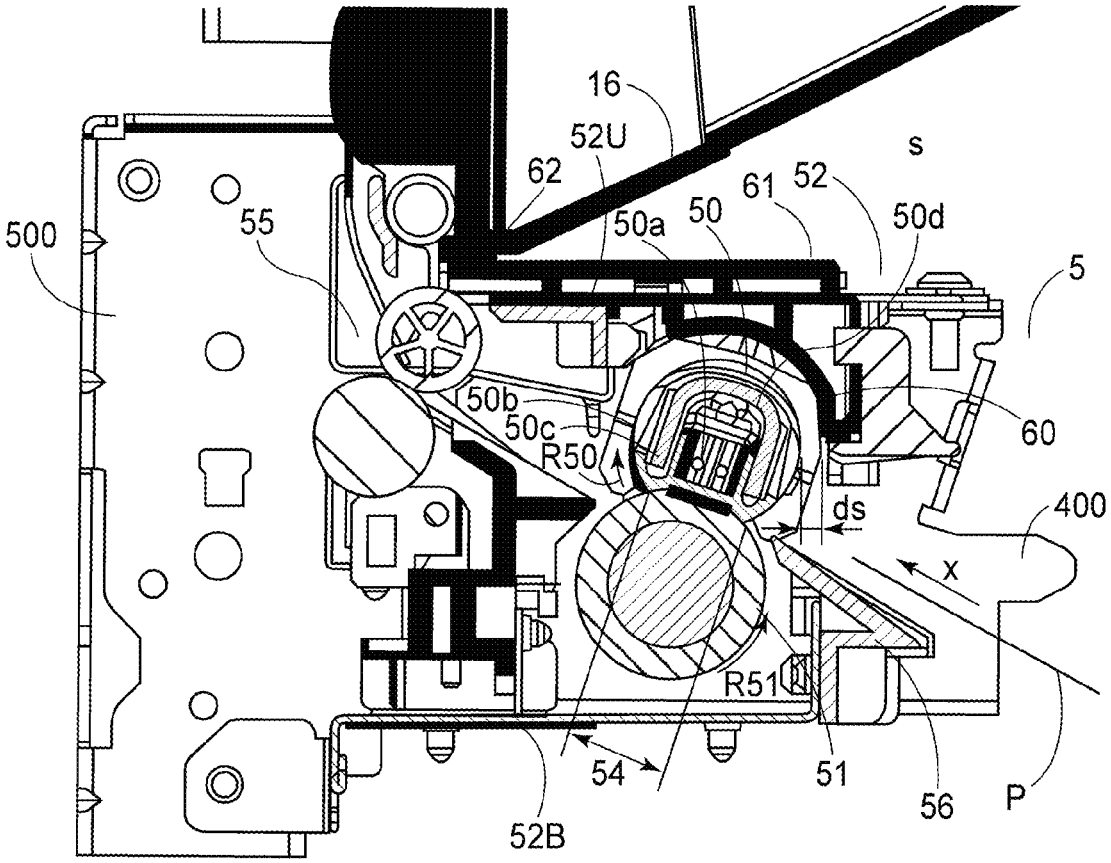
FIG. 13 is a schematic sectional view of the fixing device in the second embodiment, which shows the structure of the device.

FIG. 13 is a schematic cross-sectional view of the fixing device 5 in the second embodiment of the present invention. The image forming apparatus 1 in the second embodiment is similar in structure to the one in the first embodiment, except that an elastic component 62 is provided between the fixing device 5 and the main assembly of the image forming apparatus 1. In other words, the image forming apparatus 1 in this embodiment has an air induction route, but does not have an air exhaust route. Otherwise, the fixing device 5 in this embodiment is the same as that of the fixing device 5 in the first embodiment. That is, the characteristic feature of this image forming apparatus (fixing device 5) is that the air outlet of the space S is blocked, and therefore, once the above-described air current enters the space S, it does not flow out of the space S.

Because the air exit of the space S which is above the fixing device 5 is blocked, the confined dust in the space S increases in density. Therefore, it is facilitated for the dust particles to collide with each other and coalesce. Thus, it does not occur that the dust accumulates in the area within the recording paper passage. In other words, it is possible to prevent the dust from adhering to a sheet P of recording paper.

That is, the temperature of the fixation sleeve 50*b* will have increased to roughly 180° C., and therefore, the space S, which is above the fixing device 5, increases in temperature to roughly 60° C. While the temperature of the space S increase, upward draft is generated above the fixing device 5. Therefore, the dust which was generated in the adjacencies of the recording paper entrance 400 (nip entrance 54*c*) is moved toward the space S by the updraft. As the dust is caught by the space S and kept confined in the space, the dust in the space S increases in density, the dust particles are increased in the frequency with which they collide with each other and coalesce. Therefore, it is possible to prevent the dust from scattering in the image forming apparatus 1.

Figure 14:
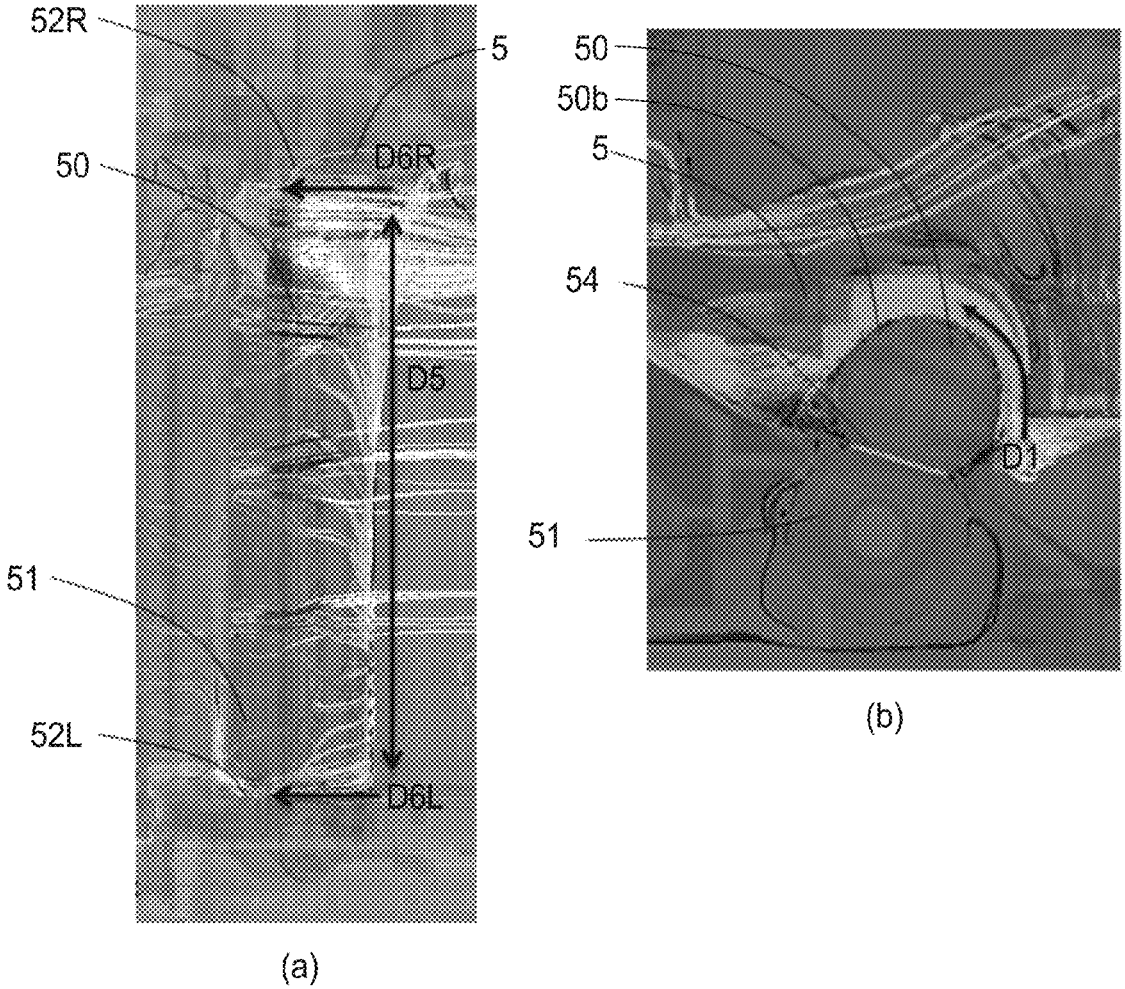
FIG. 14 is a drawing for showing the hypothetical routes, through which hypothetical microscopic particles, generated in the adjacencies of the fixation nip entrance in the thermal air current analysis, flow in the casing of the image forming apparatus.

FIG. 14 shows the likely routes through which the dust parities flow in a fixing device 5 which does not have the first air current blocking component 60 and second air current blocking component 61, with which the fixing device 5 in the first embodiment is provided. That is, it shows the likely routes through which hypothetical dust particles which are zero in weight and generated in the adjacencies of the recording paper entrance 400 (nip entrance 54*c*), flow in a simulation program. This method is used to theoretically study the air current routes by simulation.

Hypothetical particles (equivalent to dust) include such particles that move upward after colliding with the portions of the fixing device 5, which are in the adjacencies of the recording paper entrance 400 (nip entrance 54*c*) (route D1: FIG. 14(*b*)). They include also such particles that move toward the shaft of the heating unit 50 or pressure roller 51 (route D5: FIG. 14(*a*)).

After the hypothetical particles moved toward the shaft of the heating unit 50, they move through the gap between the left lateral plate 52L or right lateral plate 52R, and the heating unit 50 or pressure roller 51, (route D6L, D6R: FIG. 14(*a*)), and scatter in the image forming apparatus 1. Thus, by blocking the routes D1, D6L and D6R, it is possible to prevent the dust from scattering in the image forming apparatus 1.

Figure 15:
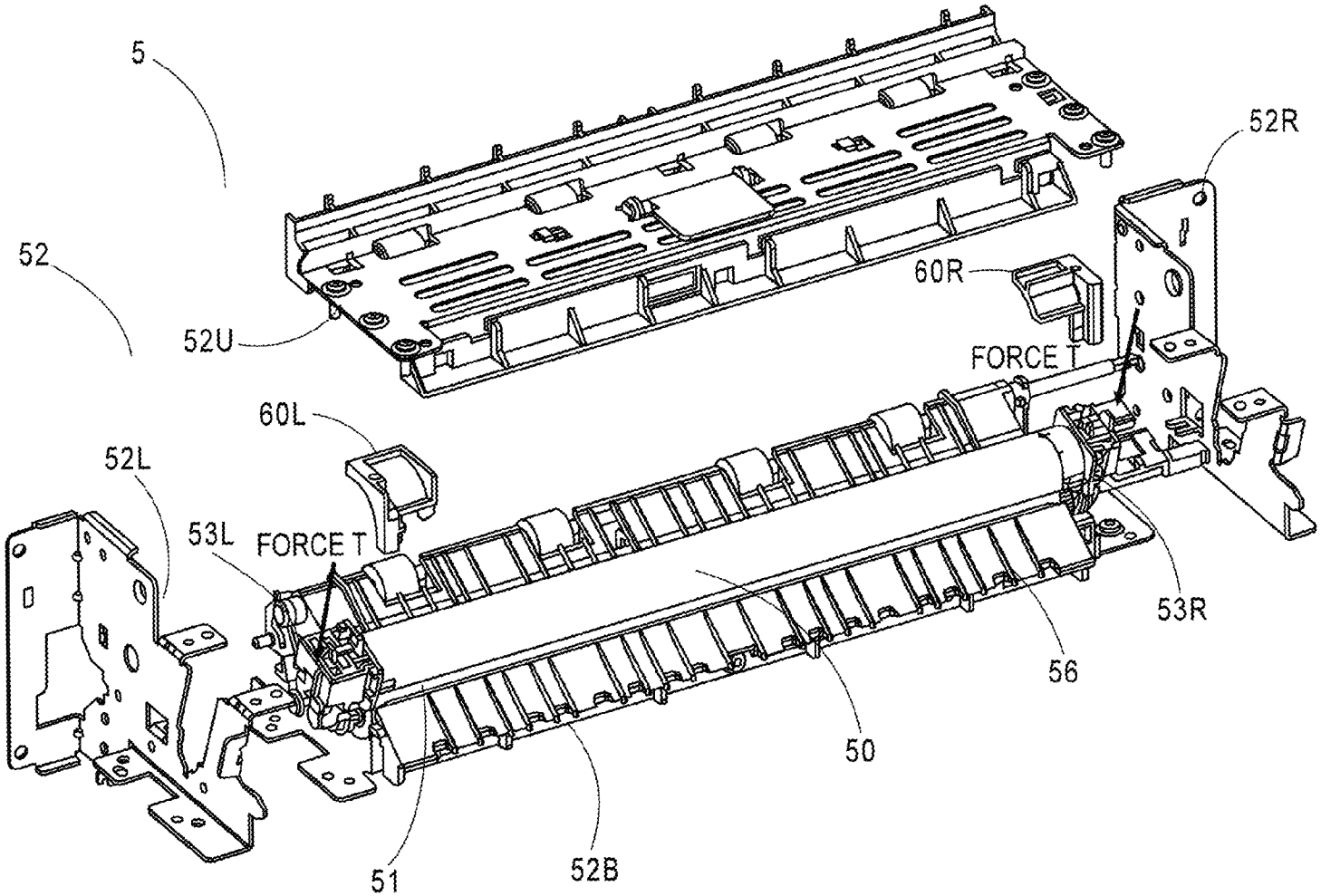
FIG. 15 is an exploded perspective view of the fixing device in the third embodiment.
Figure 16:
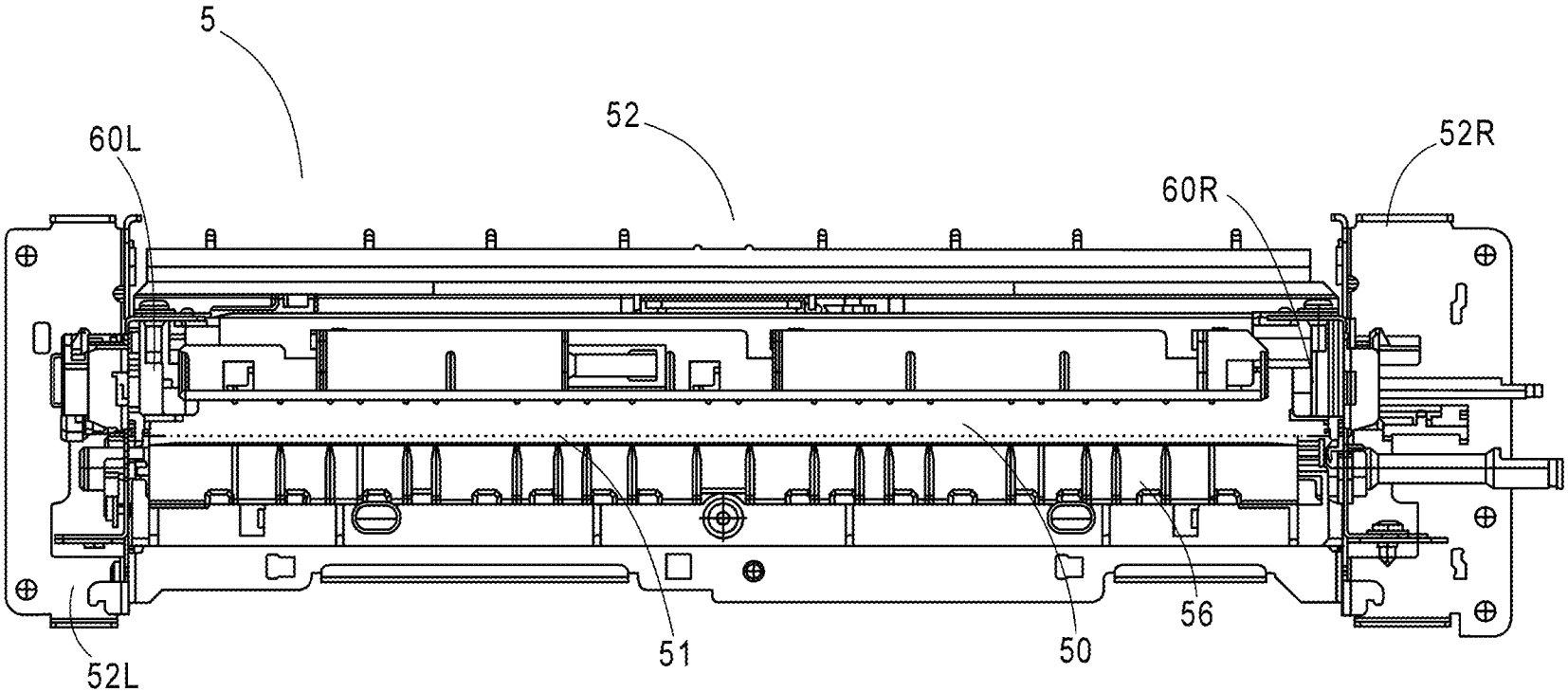
FIG. 16 is a plan view (front view) of the fixing device, as seen from the nip entrance side.

FIG. 15 is an exploded perspective view of the fixing device 5 in the third embodiment of the present invention, and FIG. 16 is a plan (front) view of the fixing device 5 as seen from the recording paper entrance 400 (nip entrance 45*c*) side. That is, in this embodiment, the third air current blocking component (blocking component) 60L and 60R are disposed in a manner to practically completely block the gap between the casing 52 and each of the lengthwise ends of the fixation sleeve 50*b*, in the adjacencies of the recording paper entrance 400 (nip entrance 54*c*). Because the routes D6L and D6R are blocked by this third air current blocking components 60L and 60R, the above described air current is prevented from flowing toward the recording paper exit 500.

More concretely, the third air current blocking components 60L and 60R extend outward from the inward side of the left and right lateral plates 52L and 52R in the length direction of the fixation unit 50*b*, to the lengthwise ends of the heating unit 50. They are disposed in the gap which is in the adjacencies of the left and right lateral plates 52L and 52R, and the recording paper entrance 400 (nip entrance 54*c*) between the heating unit 50 and pressure roller 51. With the third air current blocking components 60L and 60R being positioned as described above, the routes D6L and D6R are blocked, and therefore, the dust is prevented from scattering in the image forming apparatus 1. By the way, a component such as the third air current blocking component may be placed in the gap between the lengthwise ends of the casing 52 and those of the pressure roller 51 to almost completely block these gaps.

Embodiment 4

Figure 17:
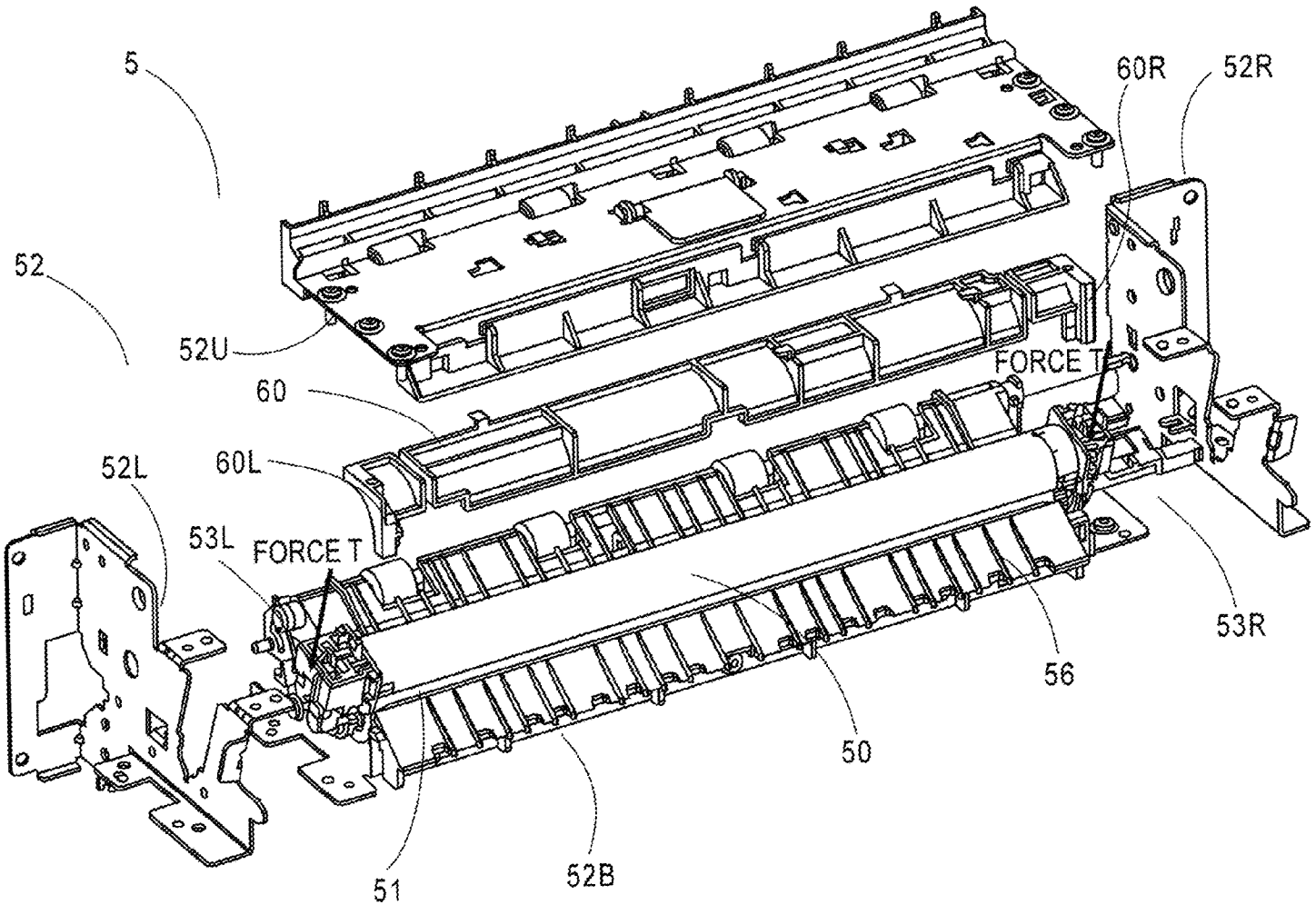
FIG. 17 is an exploded perspective view of the fixing device in the fourth embodiment.

FIG. 17 is an exploded perspective view of the fixing device 5 in the fourth embodiment of the present invention. Also in the case of this embodiment, the image forming apparatus 1 (fixing device 5) is provided with the third air current blocking components (end area blocking components) 60L and 60R as in the third embodiment. That is, the components 60L and 60R extend from the inward side of the left and right lateral plates 52L and 52R to the lengthwise ends of the heating unit 50. Further, these components 60L and 60R are in connection to the first air current blocking component 60. Thus, the routes D6L and D6R (FIG. 14(*a*)) are blocked.

Further, the first air current blocking component 60 (inside blocking component) 60 is disposed in the adjacencies of the recording paper entrance 400 (nip entrance 54*c*) of the heating unit 50, in the casing 52, in a manner to plug the gap between the fixation sleeve 50*b* and top cover 52U. This first air current blocking component 60 can block the route D1 to prevent the dust from scattering in the image forming apparatus 1.

Embodiment 5

Figure 18:
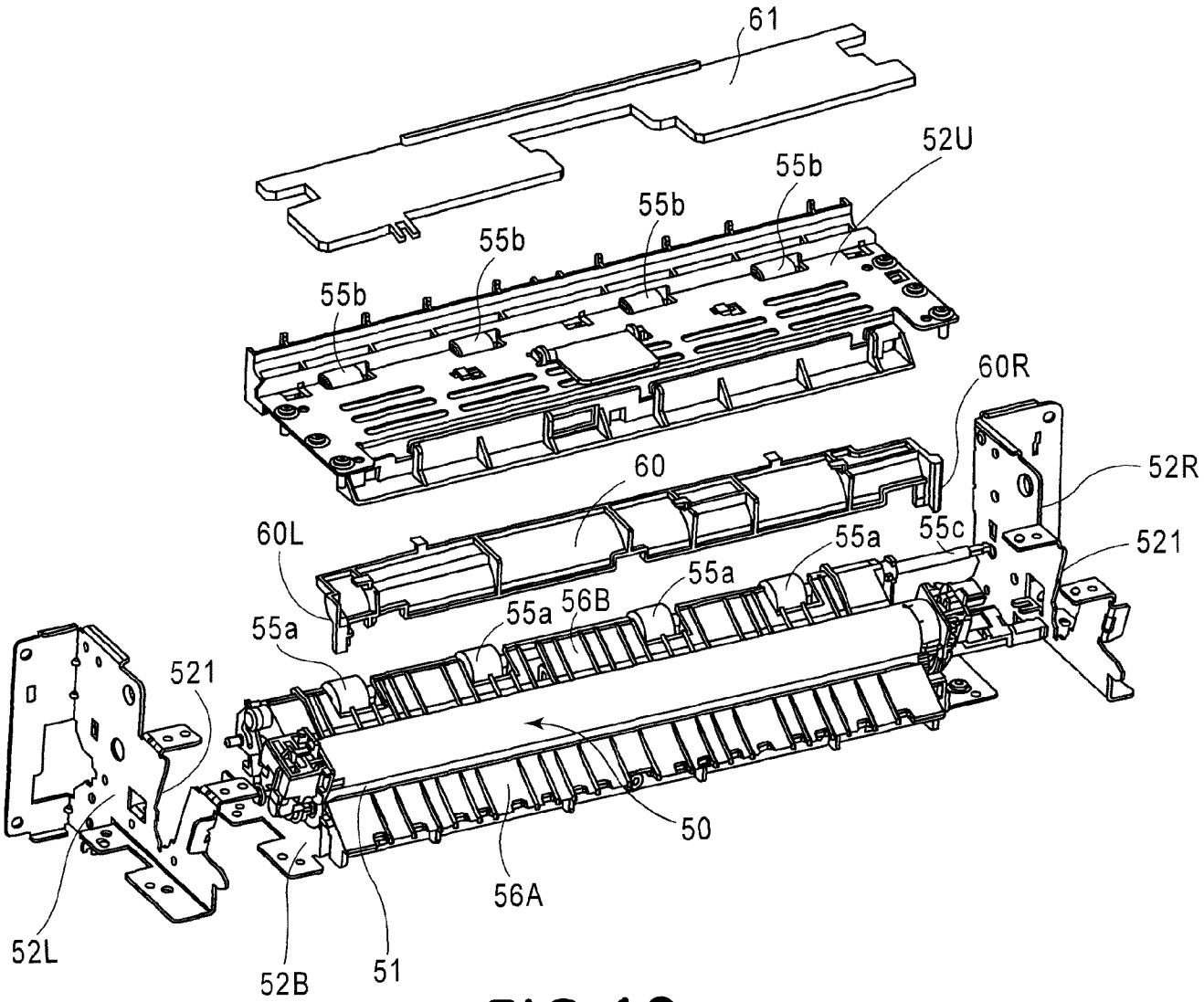
FIG. 18 is an exploded perspective view of the fixing device in the fifth embodiment.

FIG. 18 is an exploded perspective view of the fixing device 5 in the fifth embodiment of the present invention. In the case of this embodiment, not only is the fixing device 5 is provided with the first air current blocking component 60 (FIGS. 3(*a*) and 3(*b*)), but also, a pair of end area blocking components 60L and 60R which are integral parts of the first air current blocking component 60. Otherwise, the structure of the fixing device 5 in this embodiment is the same as that of the fixing device 5 in the first embodiment. That is, one of the characteristic features of the fixing device 5 in this embodiment is that the third air current blocking components 60L and 60R are provided as integral end portions of the first air current blocking component 60 (internal current blocking components) 60, for example.

The first air current blocking component 60 is disposed in the adjacencies of the recording paper entrance 400 (nip entrance 54*c*) of the heating unit 50, in the casing 52, in a manner to block the gap between the fixation sleeve 50*b* and top cover 52U, to block the route D1.

In addition, the left and right ends of the first air current blocking component 60 are provided with the end area blocking components 60L and 60R, which extend from the inward side of the left and right lateral plates 52L and 52R, respectively, toward the rotational axis of the heating unit 50. Further, they are placed in the gaps between the left and right lateral plates 52L and 52R, and the nip entrance 54*c* between the heating unit 50 and pressure roller 51, respectively.

Therefore, it is possible to block the routes D1, D6L, and D6R to prevent the dust from scattering in the image forming apparatus 1.

<Miscellanies>

1) The various structural features of the fixing devices in the first to firth embodiments of the present invention, which characterize the first to fifth embodiments, can be employed in an appropriate combination to yield fixing devices different in structure from those in the first to fifth embodiment.

2) In the embodiments 1-5 described above, the fixing devices were structured so that the fixation sleeve 50*b*, as a rotational heating component (first rotational component), which the fixing devices have, is rotationally driven by the pressure roller 51, as a pressure applying rotational component (second rotational component). However, these embodiments are not intended to limit the present invention in scope. For example, the present invention is also applicable to any of fixing apparatuses (devices) which employs an endless and flexible fixation belt as a rotational heating component, and is structured so that the fixation belt is supported by multiple belt supporting rollers, and also, so that the fixation belt is circularly driven by one of the belt supporting rollers. Further, the present invention is also applicable to any of fixing devices which employ a fixation roller in place of a fixation sleeve or fixation belt.

3) In the embodiments 1-5, the fixing devices employed a flat heater as a part of heating system for heating the fixation sleeve 50*b* as a rotational heating component. However, the choice of a heating system with which the present invention is compatible is not limited to the heating systems in the embodiments 1-5. For example, the present invention is also compatible with heating systems which employ an excitation coil for inductively heating the fixation sleeve, a halogen heater, an infrared lamp, or the like. In such a case, a pressure application pad for pressing the fixation sleeve 50*b* toward the pressure roller from within the fixation sleeve is employed. Further, the present invention is also applicable to a fixing device structured so that its heating system is disposed on the outward side of the loop which the fixation sleeve forms.

4) In the embodiments 1-5, the pressure roller 51 was employed as the pressure applying rotational component for the fixing devices. However, the present invention is also applicable to fixing devices structured to employ a pressure application belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 199238/2013 and 199239/2013 filed Sep. 26, 2013 and Sep. 26, 2013, respectively, which are hereby incorporated by reference.

What is claimed is:

1. An image forming apparatus comprising:

an image forming station configured to form a toner image on a sheet with a toner containing parting material;

first and second rotatable members forming a nip therebetween and configured to fix a toner image formed on the sheet, said second rotatable member being disposed below said first rotatable member;

a casing accommodating said first rotatable member and said second rotatable member and having a sheet introduction opening and a sheet discharge opening;

a suppression portion provided adjacent a surface of said first rotatable member in a space extending from said sheet introduction opening to said sheet discharge opening in said casing and configured to suppress scattering of particles of predetermined particle sizes resulting from the toner containing parting material, said suppression portion being disposed so that a gap G (mm) from said first rotatable member and a peripheral speed V (mm/s) of said first rotatable member satisfy $0.5 \leq G \leq 0.0059 \times V + 0.72$; and a substantially closed chamber provided above said casing and having an entrance for permitting entering of said particles guided to the outside of said casing by said suppression portion to stagnate the particles.

2. An apparatus according to claim 1, wherein said closed chamber is provided with an outlet having an opening area smaller than that of said entrance.

3. An apparatus according to claim 2, wherein said suppression portion is disposed adjacent to said sheet introduction opening.

4. An apparatus according to claim 3, wherein a plurality of such suppression portions are arranged along a rotational moving direction of said first rotatable member at predetermined intervals.

5. An apparatus according to claim 4, wherein said suppression portion includes a rib portion extending from said casing.

6. An apparatus according to claim 5, wherein said suppression portion is integrally molded with said casing.

7. An apparatus according to claim 2, wherein said suppression portion extends beyond a range through which a sheet, having a maximum width usable with said device, in a widthwise direction at opposite widthwise end portions, passes.

8. An apparatus according to claim 1, wherein $115 \leq V \leq 200$ is satisfied.

9. An apparatus according to claim 1, further comprising a first closing portion substantially closing a gap between said casing and one longitudinal end of said first rotatable member and a second closing portion substantially closing a gap between said casing and the other longitudinal end of said first rotatable member.

10. An apparatus according to claim 1, wherein said parting material is wax, and the predetermined particle size is not less than 5.6 nm and not more than 560 nm.

11. An apparatus according to claim 1, wherein said first rotatable member is contactable to a surface of the sheet carrying the toner image.

12. A fixing device comprising:

first and second rotatable members forming a nip therebetween and configured to fix a toner image formed on the sheet by an image forming station using toner containing parting material, said second rotatable member being disposed below said first rotatable member;

a casing accommodating said first rotatable member and said second rotatable member and having a sheet introduction opening and a sheet discharge opening;

a suppression portion provided adjacent a surface of said first rotatable member in a space extending from said sheet introduction opening to said sheet discharge opening in said casing and configured to suppress scattering of particles of predetermined particle sizes resulting from the parting material, said suppression portion being disposed so that a gap G (mm) from said first rotatable member and a peripheral speed V (mm/s) of said first rotatable member satisfy $0.5 \leq G \leq 0.0059 \times V + 0.72$;

a first closing portion substantially closing a gap between said casing and one longitudinal end of said first rotatable member; and a second closing portion substantially closing a gap between said casing and the other longitudinal end of said first rotatable member.

* * * * *